US011229255B2

(12) United States Patent
Herbert et al.

(10) Patent No.: US 11,229,255 B2
(45) Date of Patent: Jan. 25, 2022

(54) HELMET

(71) Applicant: JMH Consulting Group, LLC, Winchester, MA (US)

(72) Inventors: John Michael Herbert, Winchester, MA (US); Bryan R. Hotaling, Harvard, MA (US); Patrick J. Devine, Townsend, MA (US)

(73) Assignee: JMH Consulting Group, LLC, Winchester, MA (US)

( * ) Notice: Subject to any disclaimer, the term of this patent is extended or adjusted under 35 U.S.C. 154(b) by 0 days.

(21) Appl. No.: 15/712,084

(22) Filed: Sep. 21, 2017

(65) Prior Publication Data

US 2018/0125143 A1 May 10, 2018

Related U.S. Application Data

(60) Provisional application No. 62/483,836, filed on Apr. 10, 2017, provisional application No. 62/481,640,
(Continued)

(51) Int. Cl.
*A42B 3/12* (2006.01)
*A42B 3/06* (2006.01)
*A63B 71/10* (2006.01)

(52) U.S. Cl.
CPC ..... *A42B 3/122* (2013.01); *A42B 3/06* (2013.01); *A42B 3/121* (2013.01); *A42B 3/128* (2013.01); *A63B 71/10* (2013.01)

(58) Field of Classification Search
CPC ..... A42B 3/122; A42B 3/128; A42B 3/04; A42B 3/06; A42B 3/064; A42B 3/32; A42B 3/322; A63B 71/10
(Continued)

(56) References Cited

U.S. PATENT DOCUMENTS 1,698,769 A 1/1929 Mullins
3,107,356 A 10/1963 Pestronk et al.
(Continued)

FOREIGN PATENT DOCUMENTS

EP 1 034 710 9/2000

OTHER PUBLICATIONS

Invitation to Pay Additional Fees for International Application No. PCT/US2017/060220, dated Jan. 9, 2018.
(Continued)

*Primary Examiner* — Sally Haden
(74) *Attorney, Agent, or Firm* — Wolf, Greenfield & Sacks, P.C.

(57) ABSTRACT

A helmet assembly includes an upper member, a lower member, and rigid or semi-rigid plates connected between the two members. The helmet may include a series of fluidly connected air compartments beneath the plates is disclosed. Embodiments of the helmet may dissipate impact energy in multiple ways including deformation of the plates, shifting of the plates, cushioning of the plates against a resilient compressible material present in the upper member, compression of air within the air compartments, movement of air within the air compartments, and/or expansion of air in non-impacted sections of the air compartments which causes the shifting of non-impacted plates. Springs with or without resilient, compressible inserts may be positioned between movable plates and a frame member. A spine including compressible material may extend along a top section of the helmet and connect plates on opposite sides of the helmet.

17 Claims, 39 Drawing Sheets

Related U.S. Application Data filed on Apr. 4, 2017, provisional application No. 62/419,271, filed on Nov. 8, 2016.

(58) Field of Classification Search
USPC ..... 2/425, 6.8, 411
See application file for complete search history.

(56) References Cited

U.S. PATENT DOCUMENTS 3,425,061 A 2/1969 Webb
3,713,640 A 1/1973 Margan
3,872,511 A * 3/1975 Nichols ..... A42B 3/121 2/413
4,038,700 A 8/1977 Györy
4,287,613 A 9/1981 Schulz
4,354,284 A 10/1982 Gooding
4,665,569 A 5/1987 Santini
5,337,420 A * 8/1994 Haysom ..... A42B 3/14 2/181
5,544,367 A 8/1996 March, II
5,661,854 A 9/1997 March, II
5,790,988 A 8/1998 Guadagnino, Jr. et al.
5,890,232 A 4/1999 Park
5,956,777 A 9/1999 Popovich
6,073,271 A 6/2000 Alexander et al.
6,154,889 A 12/2000 Moore, III et al.
6,226,801 B1 5/2001 Alexander et al.
6,237,598 B1 5/2001 Sereboff
6,343,385 B1 2/2002 Katz
6,378,140 B1 * 4/2002 Abraham ..... A42B 3/064 2/411
6,434,755 B1 8/2002 Halstead et al.
6,681,408 B2 1/2004 Ku
6,773,785 B1 8/2004 Huang
6,934,971 B2 8/2005 Ide et al.
7,673,351 B2 3/2010 Copeland et al.
8,296,867 B2 10/2012 Rudd et al.
8,544,117 B2 10/2013 Erb et al.
8,739,317 B2 6/2014 Abernethy
8,844,066 B1 9/2014 Whitcomb
8,850,622 B2 * 10/2014 Finiel ..... A42B 3/125 2/410
9,089,180 B2 7/2015 Phipps et al.
9,173,445 B1 11/2015 Whitcomb
9,408,428 B2 8/2016 Gaudet
9,420,842 B2 8/2016 Witcher
9,468,249 B2 10/2016 Fraser et al.
9,545,125 B2 * 1/2017 Yoon ..... A41D 13/015
9,833,684 B2 12/2017 Warmouth et al.
10,632,360 B2 4/2020 Warmouth et al.
2005/0257312 A1 * 11/2005 Puchalski ..... A42B 3/064 2/411
2006/0168712 A1 * 8/2006 Mazzoccoli ..... A42B 3/12 2/411
2007/0157370 A1 7/2007 Joubert Des Ouches
2011/0162131 A1 * 7/2011 Harty ..... A42B 3/0473 2/413
2011/0271426 A1 * 11/2011 Roesler ..... A42B 1/08 2/410
2012/0047635 A1 3/2012 Finiel et al.
2012/0066820 A1 3/2012 Fresco
2012/0131730 A1 5/2012 Shoham et al.
2012/0233745 A1 * 9/2012 Veazie ..... A42B 3/121 2/413
2012/0317705 A1 12/2012 Lindsay
2013/0061374 A1 3/2013 Cleva
2013/0232668 A1 9/2013 Suddaby
2013/0247284 A1 9/2013 Hoshizaki et al.
2013/0298316 A1 11/2013 Jacob
2013/0305435 A1 11/2013 Surabhi
2014/0020157 A1 1/2014 Barr
2014/0068841 A1 * 3/2014 Brown ..... A42B 3/122 2/413
2014/0215694 A1 * 8/2014 Grice ..... A42B 3/06 2/411
2014/0298572 A1 10/2014 Mazzoccoli
2014/0310856 A1 * 10/2014 Guadagnin ..... A42B 3/322 2/417
2015/0282547 A1 10/2015 Dhia
2016/0000168 A1 1/2016 Allen
2016/0053843 A1 2/2016 Subhash et al.

OTHER PUBLICATIONS

Lambert, Hits, Heads, Helmets: Harvard Football Alumni Protecting the Next Generation. Harvard Varsity Club: News & Views of Harvard Sports. Jan. 27, 2010;52(5):2 pages.
Extended European Search Report for European Application No. 17868732.3, dated May 20, 2020.
International Search Report and Written Opinion for International Application No. PCT/US2017/060220, dated Mar. 6, 2018.
EP17868732.3, dated May 20, 2020, Extended European Search Report.
International Preliminary Report on Patentability for International Application No. PCT/US2017/060220, dated May 23, 2019.
PCT/US2017/060220, dated Mar. 6, 2018, International Search Report and Written Opinion.

* cited by examiner

HELMET

CROSS-REFERENCE TO RELATED APPLICATIONS

This application claims the benefit under 35 U.S.C. § 119(e) of U.S. Provisional Application No. 62/483,836, filed Apr. 10, 2017, U.S. Provisional Application No. 62/481,640, filed Apr. 4, 2017, and U.S. Provisional Application No. 62/419,271, filed Nov. 8, 2016, each of which is hereby incorporated by reference in its entirety.

FIELD

The disclosed embodiments relate generally to helmets designed to protect against impacts. More specifically, the disclosed embodiments relate to helmets designed for impact sports such as football, and more specifically to helmets with discrete plates.

DISCUSSION OF THE RELATED ART

Football helmets are designed to protect players from skull fractures and other possible head injuries endemic to the game. Such helmets typically include a hard unitary shell covering a protective foam and/or an air bladder layer such that hard impacts are buffered via distribution over the hard shell deformation of the softer inner layers. Other sports and activities often include the use of protective helmets.

SUMMARY

According to one embodiment, a helmet includes an upper frame member, a lower frame member, and a plurality of plates that are semi-rigid or rigid, the plates being movable relative to one another. The upper frame member and the lower frame member limit movement of the plates. A resilient, compressible material is positioned between the plates and the upper frame member.

According to another embodiment, a helmet includes a plurality of plates that are semi-rigid or rigid, the plates being movable relative to one another. The helmet also includes a first rigid frame member and a second rigid frame member, each of the plurality of plates being connected to the first and second rigid frame members, and each of the plurality of plates having a home position. The plates are movable relative to at least one of the first and second rigid frame members and out of their home positions.

According to another embodiment, a helmet includes a first frame member and a plurality of plates that are semi-rigid or rigid, where each plate has a first end region and is movably connected at the first end region to the first frame member. The helmet also includes a resilient, compressible material positioned between the first end regions and the first frame member such that an impact to an external surface of one of the plates compresses the resilient, compressible material positioned between the first frame member and the first end region of the plate.

According to a further embodiment, a helmet includes an upper frame member, a lower frame member, and a plurality of plates that are semi-rigid or rigid and form at least a portion of an outer shell of the helmet. The plates are movable relative to one another, and the upper frame member and the lower frame member limit movement of the plates. The plates are arranged in opposing pairs separated by the upper frame member. The helmet also includes a plurality of springs, with one or more springs being positioned between each plate and the upper frame member.

According to yet another embodiment, a helmet includes a frame member and a plurality of plates that are semi-rigid or rigid, the plates being movable relative to one another. The helmet also includes a plurality of springs coupled to the plates such that the plates are movable relative to the frame member. The helmet also includes a plurality of resilient, compressible inserts positioned within the springs.

According to a further embodiment, a helmet includes a rigid lower frame member and a plurality of plates that are semi-rigid or rigid, the plates being movable relative to adjacent plates of the plurality of plates, and the plates are movably attached to the lower frame member.

According to another embodiment, a helmet includes a protective shell and an air bladder positioned under the shell, the air bladder having a first compartment with an outwardly-facing side facing toward the protective shell, and an inwardly-facing side facing toward an interior of the helmet. The inwardly-facing side has a different flexibility than the outwardly-facing side.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
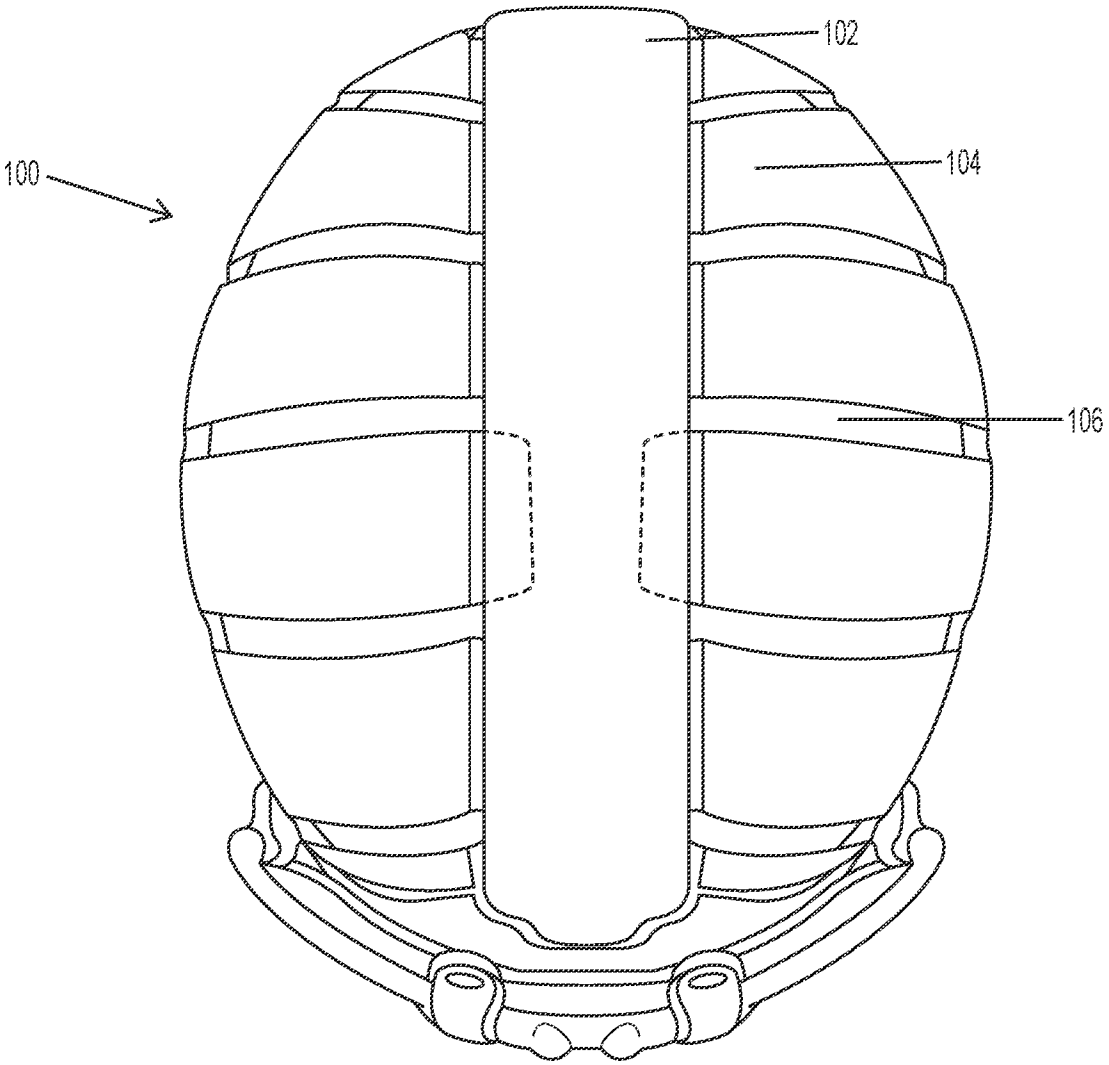
FIG. 1 is perspective top view of a helmet according to one embodiment.

It should be understood that aspects of the invention are described herein with reference to certain illustrative embodiments and the figures. The illustrative embodiments described herein are not necessarily intended to show all aspects of the invention, but rather are used to describe a few illustrative embodiments. Thus, aspects of the invention are not intended to be construed narrowly in view of the illustrative embodiments. In addition, it should be understood that aspects of the invention may be used alone or in any suitable combination with other aspects of the invention.

Various embodiments are described in connection with a helmet assembly, such as a football helmet. However, the invention is not necessarily so limited, and may be employed with other types of helmets, particularly helmets used for high impact sporting activities. Examples of helmets for other sports and activities include bicycle helmets, hard hats, hockey helmets, lacrosse helmets, skateboarding helmets, snowboarding helmets, other extreme sports helmets, cricket helmets, motorcycle helmets, horse racing helmets, ski helmets, climbing helmets, and mining helmets. One or more aspects disclosed herein may be used with these type of helmets or with other types of protective helmets. Aspects disclosed herein may be used with helmets that include face guards and with helmets that do not include face guards.

Helmets are worn for participating in many contact sports, including football, to help reduce the risks of head injury. Traditional football helmets are comprised of a single hard plastic unitary shell that fully or mostly encompasses the head other than the face. The hard plastic shell is typically supplemented with padding, straps, and/or air bladders along the inside surface to provide cushioning during impact. Energy transfer from impacts to the helmet are blunted by deformation of the rigid outer shell, and further dissipated by compression of the cushioning lining the helmet cavity.

Applicant has recognized that a non-unitary helmet structure having discrete plates which are semi-rigid or rigid may provide improved protection as compared to a unitary helmet structure can provide better head injury protection than traditional helmets. The plates may be stiff and solid, but not inflexible, and may be constructed to maintain their own shape when unsupported. The plates, when attached to one or more frame members, may provide additional modes of energy dissipation as compared to unitary helmet structures. Gaps may be provided between the plates such that the plates can shift relative to each other while still protecting against skull fractures. The plates also may be of different thicknesses to create different levels of flexibility and protection in different areas of the helmet as needed. A layer of stretchable material partially or completely attached to the plates may be included to facilitate return of the plates to their original arrangement after impact.

Applicant has also recognized that including one or more air bladders that permit air to move within the helmet can buffer impacts in at least two manners. The compression of air within an impacted bladder absorbs energy in some embodiments. The air bladders may be arranged to permit air to move to non-impacted bladders to cause expansion and/or stretching of other portions of the helmet, thereby dissipating energy. In one embodiment, the helmet is composed of a frame that has a central upper member spanning the head from the frontal region to the upper cervical region. The upper member is connected at its dorsal end with a lower member of the frame. The lower member may extend from the rear base of the helmet along both jawlines, ending at a faceguard.

Plates may be held at their upper ends by the upper member and at their lower ends by the lower member. The upper member may include a resilient, compressible foam or other material that serves as a damper when the plates are moved relative to the upper member. When a plate is impacted or moved by another plate, the plate compresses the material, dissipating energy. Movement of a plate or plates on one side of the helmet may displace a plate or plates on an opposite side of the helmet. In some embodiments, the displacement is caused by a force transmitted through the compressible material.

The plates may be spaced from one another such that a small gaps exists between adjacent plates; the gaps being small enough to prevent an adult finger from fitting between the plates.

The helmet may include a plurality of interconnected air bladders attached to the inside cavity wall of the helmet. In some embodiments of the helmet, the air bladders are inflatable via an inlet located on the back of the helmet. Compression of the air within the bladders upon helmet impact may serve to improve cushioning. In some embodiments, upon impact, air also moves between the fluidly connected bladders and causes them to expand. The air bladders may be arranged such that an impact on one side of the helmet expands an air bladder on the opposite side of the helmet, thereby moving energy to the opposite side of the helmet. The plates may be biased against expansion (e.g., with a resilient, stretchable fabric) such that the plate movement dissipates energy by stretching the fabric.

Turning now to the figures, FIG. 1 shows one embodiment of a helmet 100 according to the present disclosure. Plates 104 are separated by gaps 106 and are attached to an upper member 102. Gaps 106 allow plates 104 to move relative to one another such that when an object impacts the helmet, energy can be dissipated. The upper member 102 spans or partially spans the shape of a head depending on the embodiment. In some embodiments, plates 104 are spaced such that gaps 106 are approximately a half inch or smaller so to as to inhibit penetration by objects. For example, in some embodiments, only objects smaller than an adult-sized finger can fit through a gap 106 when the plates are in a non-expanded state. The plates can be made of any suitable polycarbonate, metal, hard plastic, or any suitable material or combination of materials to maintain the integrity of the helmet.

Figure 2:
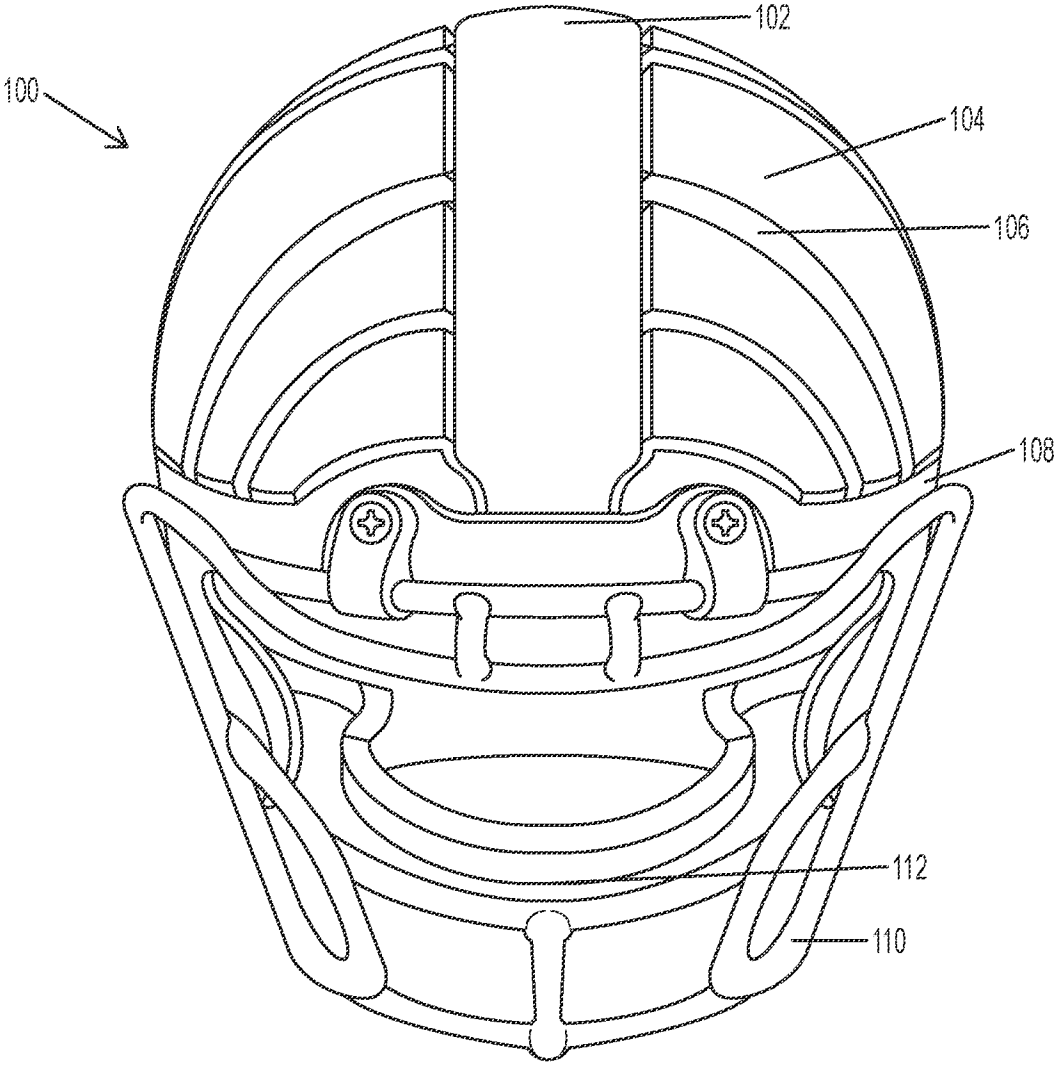
FIG. 2 is a top, front perspective view of the helmet of FIG. 1.
Figure 3:
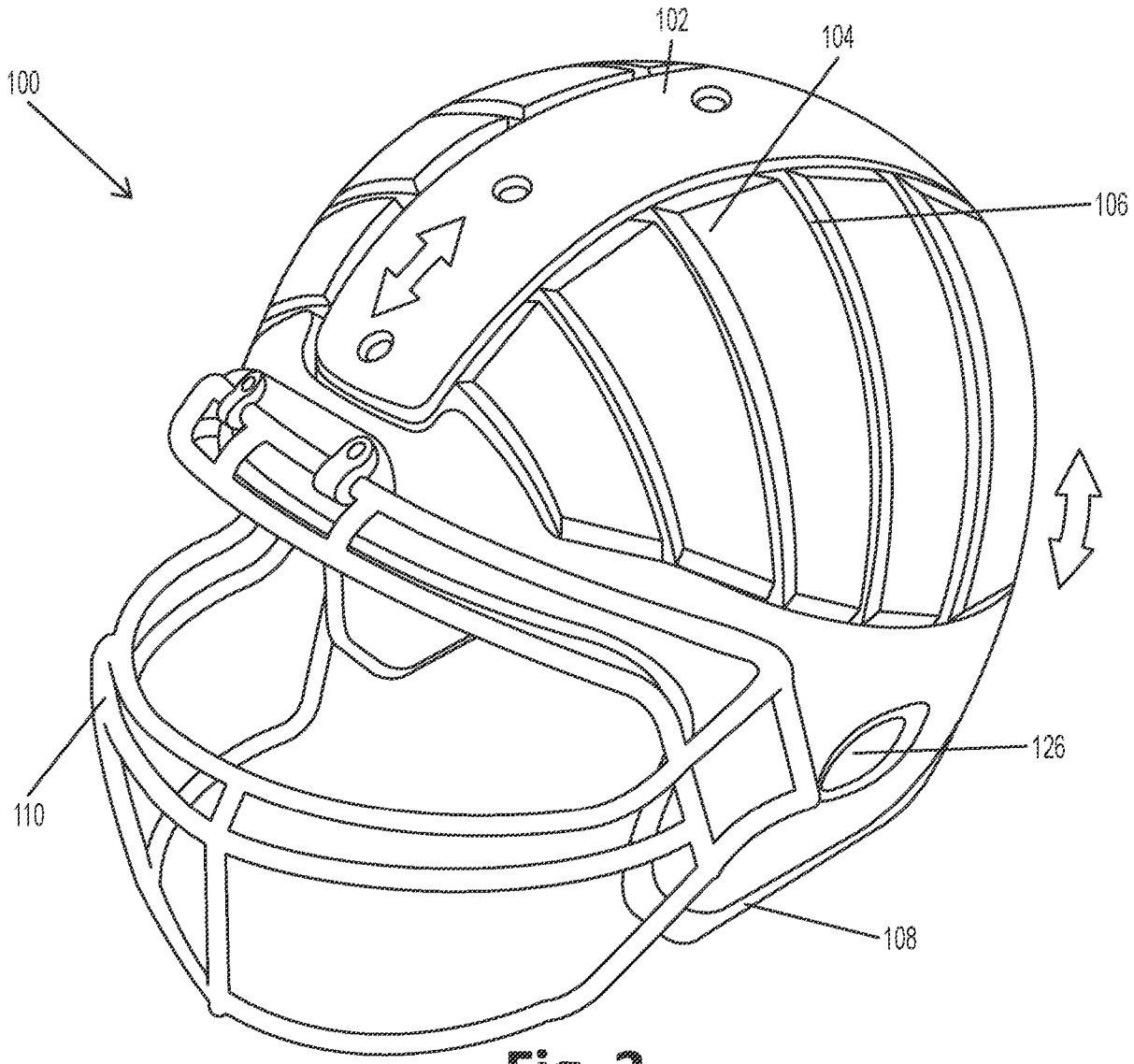
FIG. 3 is a top, front, right side perspective view of the helmet.

As may be seen in FIGS. 2 and 3, plates 104 are connected to a lower member 108, which in this embodiment extends from the rear base of the helmet along both jawlines, ending at a faceguard 110. The lower member 108 may be positioned at a higher or lower location on the helmet in various embodiments. The upper member 102 and lower member 108 may be constructed of any appropriate polycarbonate, metal, hard plastic, or any other suitable material or combination of materials to maintain the structural integrity of the helmet.

A chinstrap 112 may be attached to the lower member 108 to help maintain the stability of the helmet.

A layer of stretchable, resilient material (not shown in FIG. 4) may be attached to the underside of plates 104. When plates 104 are impacted, their movement relative to each other can stretch the resilient material, further dissipating impact energy. After impact, the resilient material may return plates 104 to an original configuration. The resilient material may include spandex, elastane, rubber, polyester-polyurethane, or any other suitable resilient material. The spandex or other material may be combined with cotton, polyester, or any other suitable material to form a sheet or other configuration of the resilient material. In some embodiments, threads of resilient material may be used to bias the plates toward an original configuration.

Figure 4:
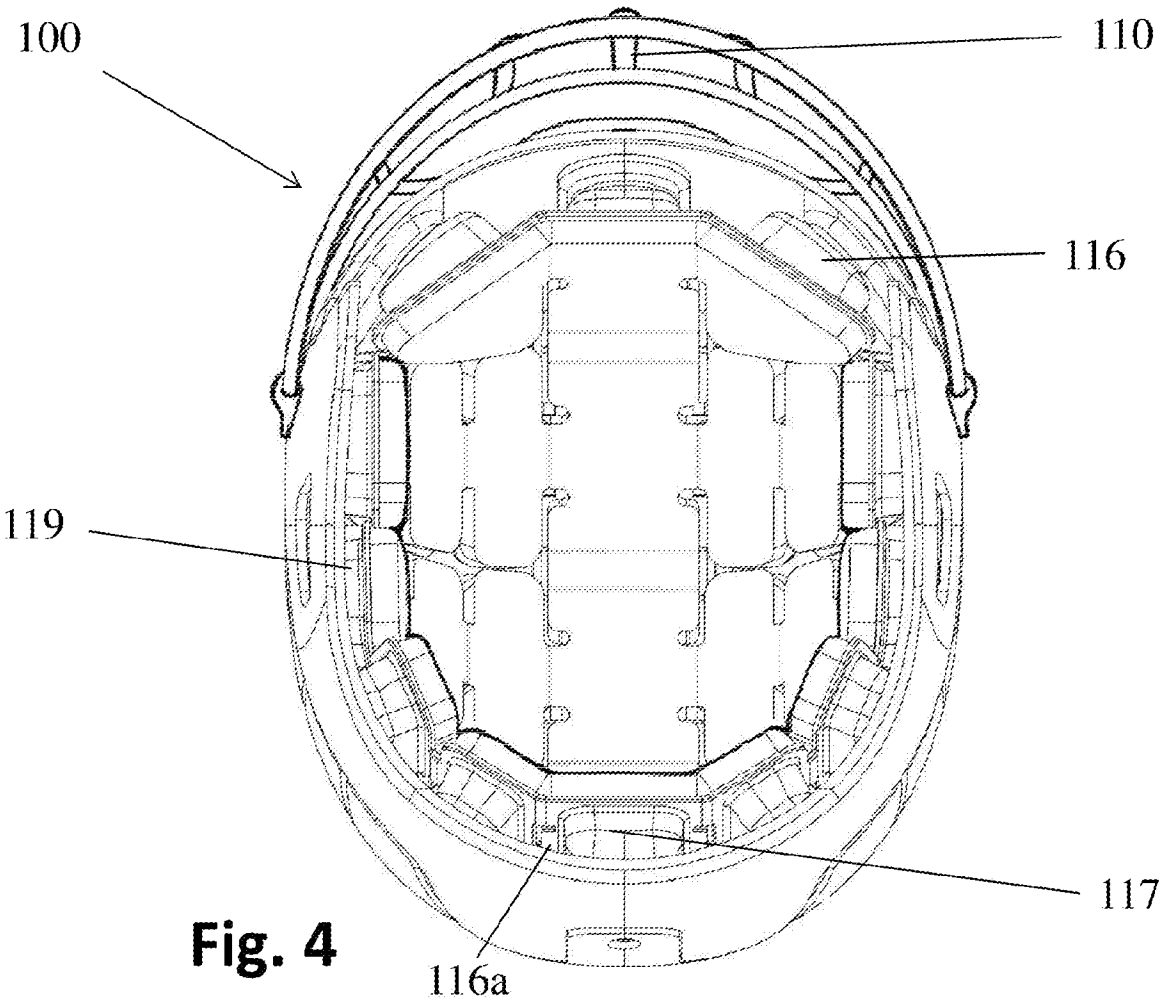
FIG. 4 is a bottom view of the helmet showing air bladders.

In the embodiment shown in FIG. 4, the resilient material layer is positioned on the entire inner cavity. In other embodiments, the resilient material may include bands attached at only parts of plates 104, or may be a series of stretchable patches forming a network of connected plates, or any other suitable attachment configuration to bias the plates 104 toward their original orientation relative to each other. In some embodiments, instead of, or in addition to a resilient material positioned on an inner side of the helmet, a resilient material layer may be positioned over the outer surfaces of the plates. For example, a resilient, stretchable material may be placed around the entire outer helmet in some embodiments. The resilient stretchable material can further be colored or otherwise patterned for cosmetic purposes. For example, logos, colors, advertising, or other graphics may be included on the resilient, stretchable material and thereby to the entire helmet. A resilient, stretchable material layer as described herein may be applied to conventional helmets in some embodiments. For example, the material may be pulled over a conventional football helmet and attached to an interior of the helmet with snaps, hook and loop fasteners, a hook and grommet arrangement, or any other suitable fastening arrangement.

One or more air bladders 116, 117, 119 may be included in embodiments of the helmet. The bladders may be connected to each other by air channels 116*a*, forming one continuous air chamber such that air can flow between the bladders. When a plate 104 is impacted, the plate deforms inwardly, compressing the air bladder. This compression forces air within the air bladder to move through the air channels and into the other air bladders, causing local expansion in those bladders. That expansion causes plates 104 adjacent to the expanding air bladders to shift, additionally dissipating impact energy. Any suitable number of air bladders may be used, and the bladders can be of any suitable shape. The air bladders can be made from any polyvinyl plastic, elastane, rubber, or any other suitable material, such as an elastic material that is tear-resistant and can house air and be attached to the inside cavity of the helmet. The illustrated air bladders are attached to the undersides of plates 104 in this embodiment, but could also be attached to the resilient material, or both, or integrated into the helmet in any other suitable manner. The air bladders can contain gases or mixtures of gases other than air. For purposes herein, a bladder containing a gas or a mixture of gases that is different than the composition of air is considered to be an air bladder.

Figure 33:
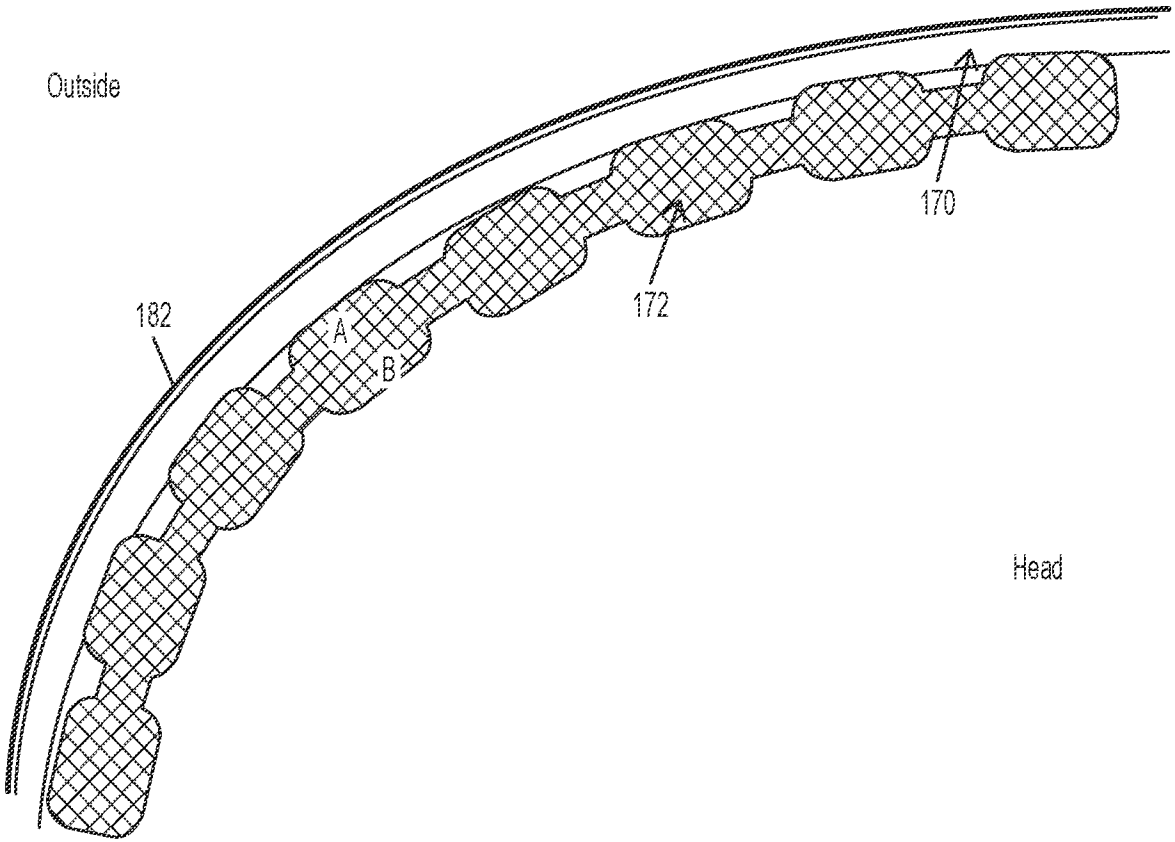
FIG. 33 is a cross-sectional view of air bladders below the plates of a helmet according to one embodiment.

As illustrated in FIG. 33, in some embodiments, the air bladders 172 may be made of different materials with varying elasticities in different parts of the air bladder. For instance, an outwardly-facing side A may be made to be more elastic than an inwardly-facing side B. With such an arrangement, impact in one area of the helmet could permit greater expansion of side A as compared to side B. Such an arrangement allows some areas to expand more than others when the air bladder 172 is impacted and fluid shifts to expand non-impacted sections. The more compliant areas may be located below the plates 170 to encourage additional reversible deformation of the helmet upon impact via shifting of plates 170, thus increasing dissipated energy. The air bladders do not have to be formed of different materials and may simply be comprised of one material with different thicknesses in different areas to accomplish a similar effect. In some embodiments, the same material may be used, and different shapes of the bladder portions may provide different flexibilities in different areas.

Figure 5:
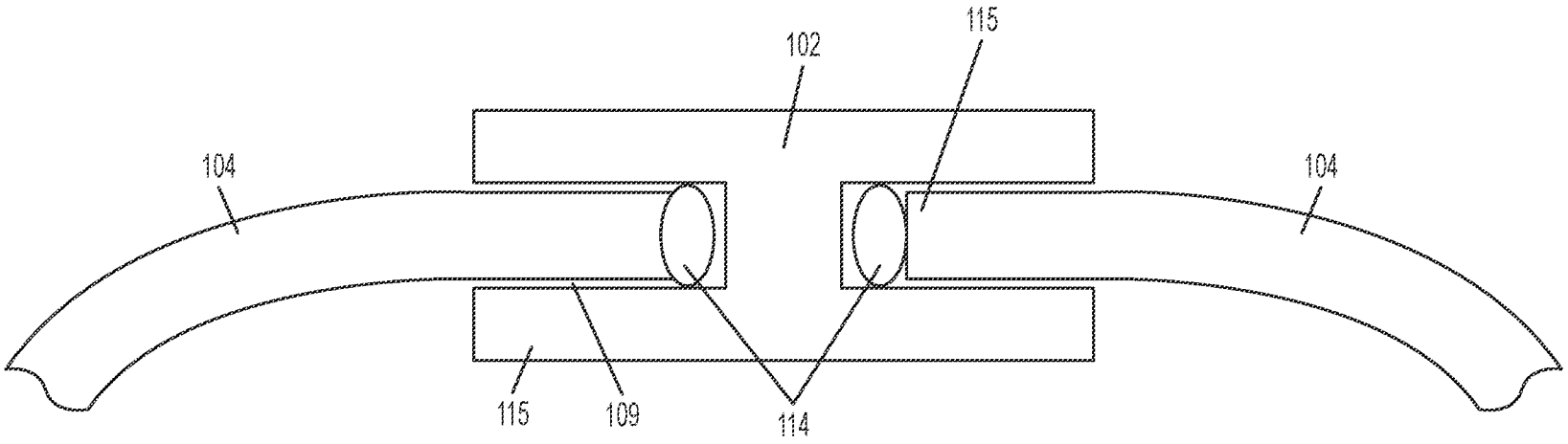
FIG. 5 is a cross-sectional view of an upper frame member of one embodiment showing first and second plates held by the upper frame member.

FIG. 5 shows a cross-sectional view of upper member 102 where opposing plates 104 are attached to upper member 102 via a compressible material 114. Each plate 104 may be adhered to the compressible material, which in turn is adhered to an inner surface of a channel 109 in upper member 102. Within upper member 102 is compressible material 114 located between plates. When plates 104 are impacted, ends 115 of the plates press inwardly on compressible material 114, which absorbs energy. Compressible material 114 can be made of any suitable foam, rubber, synthetic rubber, silicone, urethane, neoprene, nitrile, thermoplastic elastomer, set foam, formable foam, set elastomer, formable elastomer, latex, or other suitable material, or a combination thereof.

In some embodiments, a top portion 102*a* and a bottom portion 102*b* of upper member 102 extend sufficiently laterally and are sufficiently closely fitted to ends 115 tips of plates 104 such that even without an adhesive or fastener, plates 104 are connected to the upper member by being constrained against removal.

Figure 6:
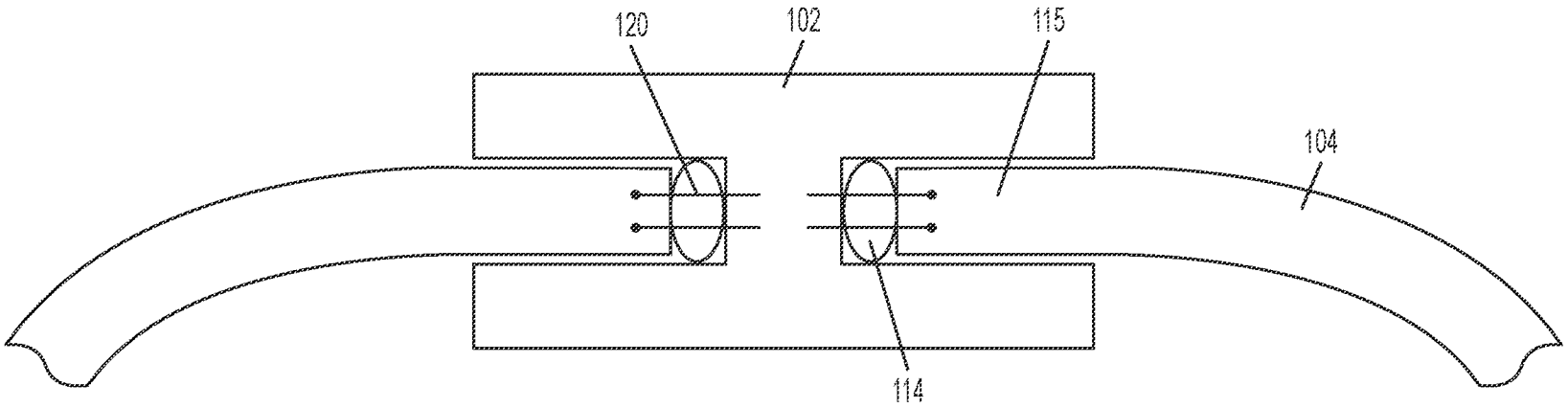
FIG. 6 is a cross-sectional view of the upper frame member of one embodiment showing first and second plates held by the member via fastening wires.

FIG. 6 shows one embodiment of one manner of connecting plates 104 to upper member 102 with a compressible material 114 between plates 104 and upper member 102. In this embodiment, wires 120 are anchored to plates 104 and upper member 102 to limit the distance that the plates can travel from the upper member. The wires may be run through compressible material 114, or around pieces of compressible material 114. While the wires 120 limit plate movement away from the upper member 102, the plates can press inwardly on compressible material 114 to dissipate impact energy.

Figure 7:
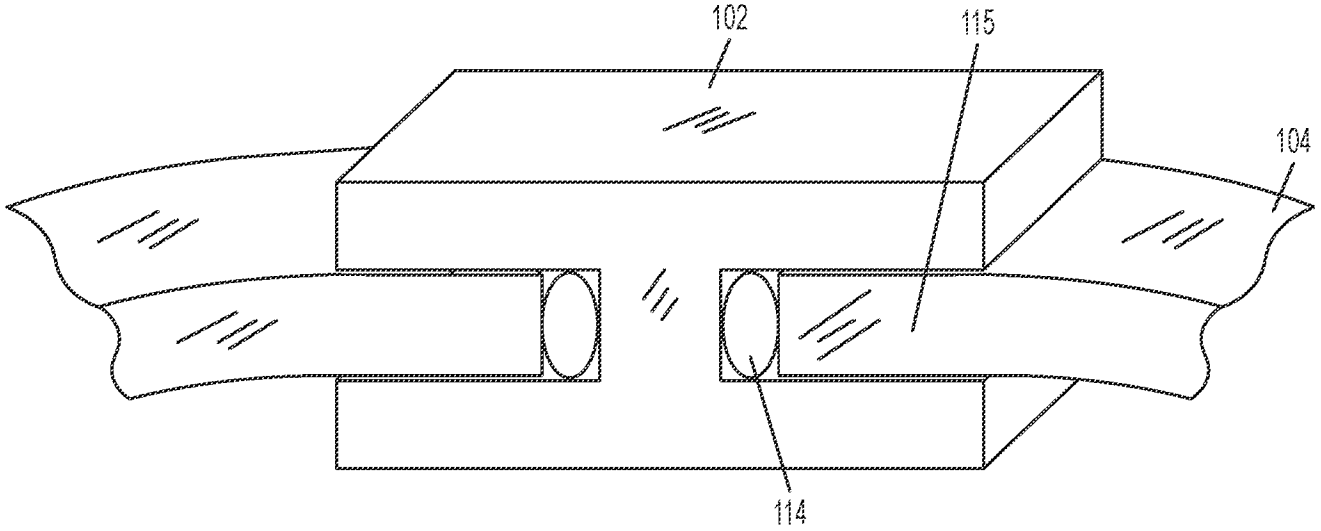
FIG. 7 is a perspective view of an upper frame member and attached helmet plates according to one embodiment.

FIG. 7 is a perspective cutaway view of one section of upper member 102 and two attached plates 104 extending from the upper member. The plates may be attached to the upper member 102 in a manner similar to that shown in FIG. 6, or in any other suitable manner.

Figure 8:
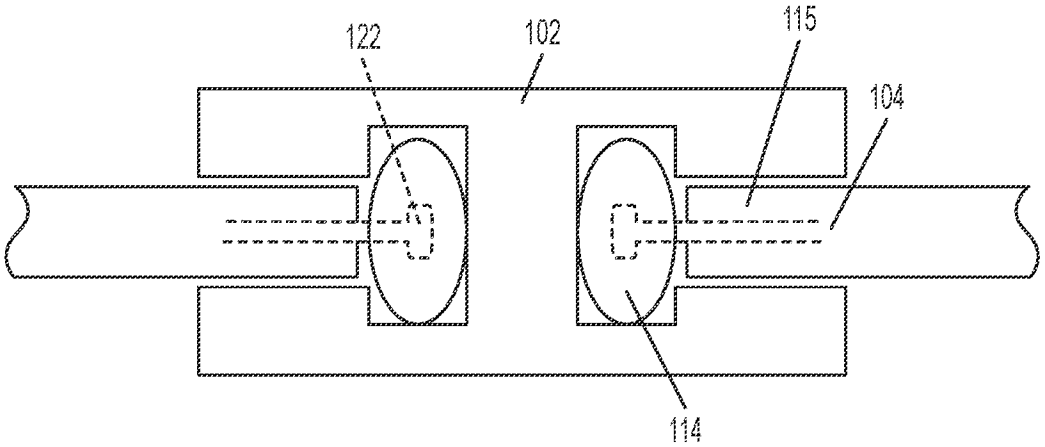
FIG. 8 is a cross-sectional view of the upper frame member of one embodiment showing first and second plates held by the member via an anchor.

FIG. 8 shows another embodiment of how plates 104 may be connected to upper member 102. In this embodiment, plates 104 have anchors 122 at their upper ends. The anchors may be integral with the plates, or may be distinct elements which are attached to the plates. Anchors 122 are set into compressible material 114, which is in turn connected to upper member 102 in any suitable manner. For example, compressible material 114 may be adhered to upper member 102, connected with one or more fasteners to upper member 102, or constrained by recesses and/or walls within upper member 102.

Figure 9:
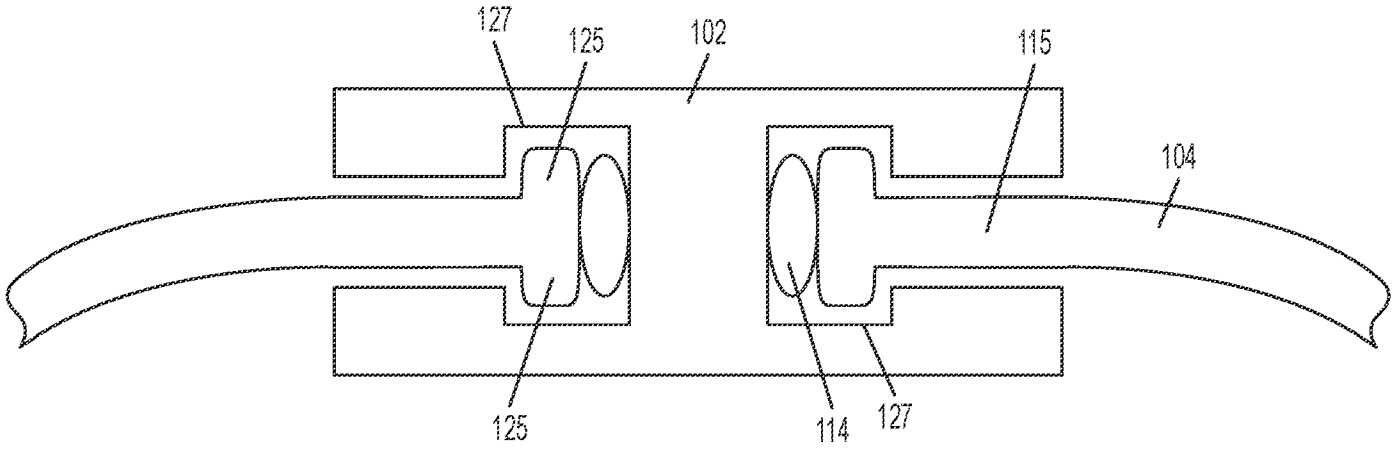
FIG. 9 is a cross-sectional view of an upper frame member of one embodiment showing a first and a second plate constrained within the upper member's recess.

FIG. 9 shows another embodiment plates 104 connected to upper member 102. In this embodiment, plates 104 have extensions 125 at their upper ends which are set into upper member 102. Upper member 102 has a recess 127 that physically constrains extensions 125 so that plate 104 cannot be easily removed through normal use. Compressible material 114 may be adhered to upper member 102, and buffers medial movements of plate 104 from impacts. While FIGS. 5, 6, 8, and 9 show three different embodiments of attaching plates 104 to upper member 102, other manners of connection may be implemented.

Figure 10:
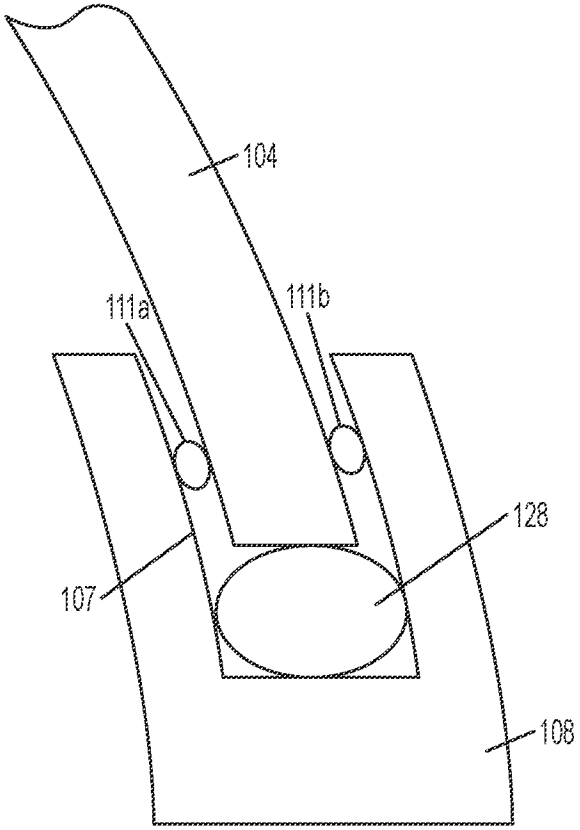
FIG. 10 is a cross-sectional view of a lower frame member of one embodiment showing a plate held by a compressible material attached to the member.

FIG. 10 is a cross-sectional view showing a lower end of plate 104 connected to lower member 108. In this embodiment, plate 104 is non-removably fastened to a compressible material 128 located within a channel 107 in lower member 108, the compressible material in turn non-removably fastened to lower member 108. A downward force on the plate 104 presses the plate into channel 107, compressing compressible material 128, which dampens the impact. Compressible material 128 can be composed of any compatible foam, rubber, polyurethane, latex, other suitable material, or a combination thereof. Additional compressible material 111*a* may be positioned along a channel inner wall that is on an inner side of the plate 104. Similarly, a compressible material 111*b* may be positioned along a channel inner wall that is on an outer side of the plate 104. Compressible materials 111*a*, 111*b* may dampen lateral forces experienced by plates 104.

Figure 11:
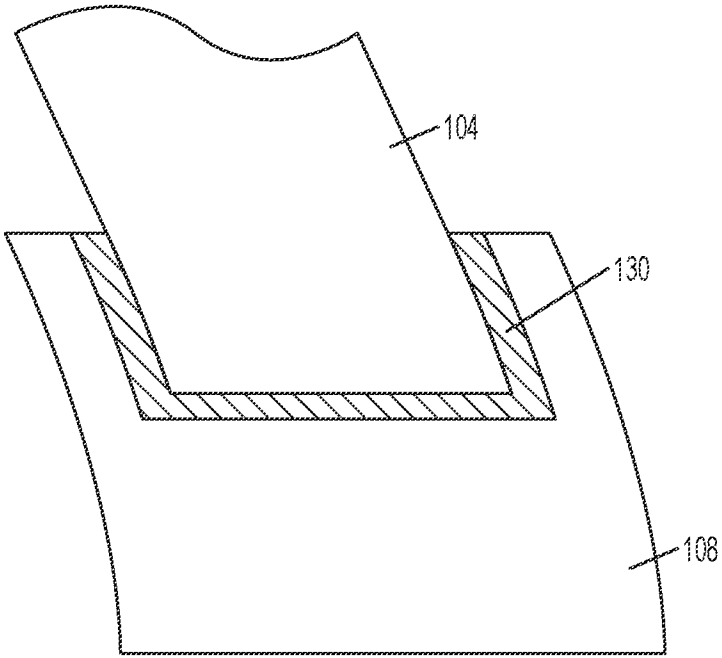
FIG. 11 is a cross-sectional view of a lower frame member of one embodiment showing a plate connected to the member.

FIG. 11 is a cross-sectional view of an alternative connection between plate 104 and lower member 108. In this embodiment, plate 104 positioned within a slot in lower member 108, and the two components are directly connected via an adhesive 130. Other direct connections may be employed, such as welding plate 104 to an inner surface of lower member 108. Such an arrangement may provide a more rigid attachment as compared to the embodiment of FIG. 10. The upper ends of plates 104 may be cushioned within upper member 102 in embodiments that include a rigid connection of plates 104 to lower member 108. In some embodiments, a direct, rigid connection may be used to connect plates 104 to upper member 102.

FIGS. 10 and 11 show two possible attachment arrangements for plates 104 and lower member 108. Other attachment arrangements may be employed with various embodiments disclosed herein. In some embodiments, lower member 108 may be integrally formed with some or all of plates 104, while the upper ends of plates are movable relative to upper member 102. In some embodiments, lower ends of plates 104 may be movable along a longitudinal direction of channel 107, but restricted from moving up or down relative to the lower member.

Energy absorbing elements may be positioned at other locations of the helmet in some embodiments. For example, in the embodiment shown in FIG. 12, a resilient, compressible material 138 is located between upper frame member 102 and a front frame member 136. With such an arrangement, the compressible material 138 may absorb some of the force of an impact to faceguard 110 and permit front frame member 136 to move relative to upper frame member 102.

Figure 12:
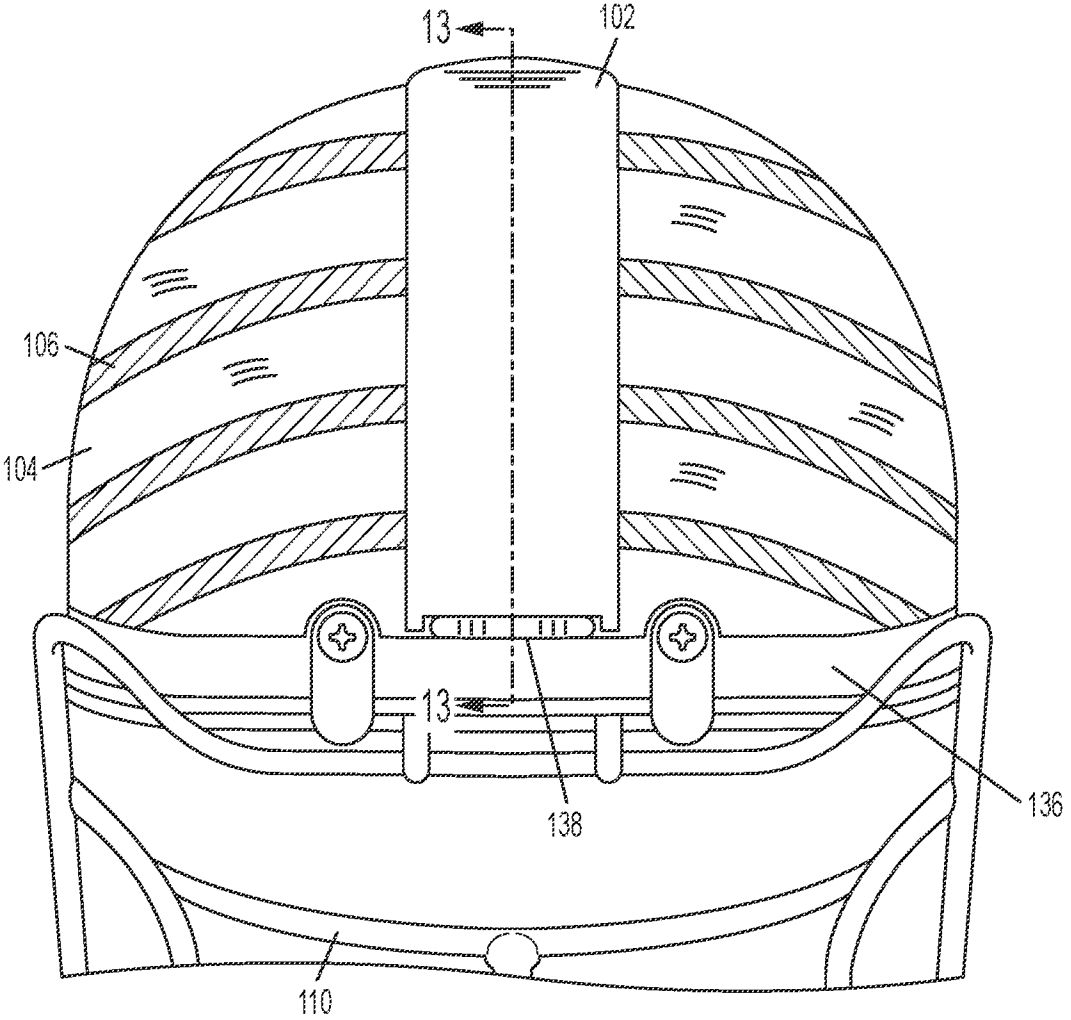
FIG. 12 shows a football helmet according to a second embodiment.
Figure 13:
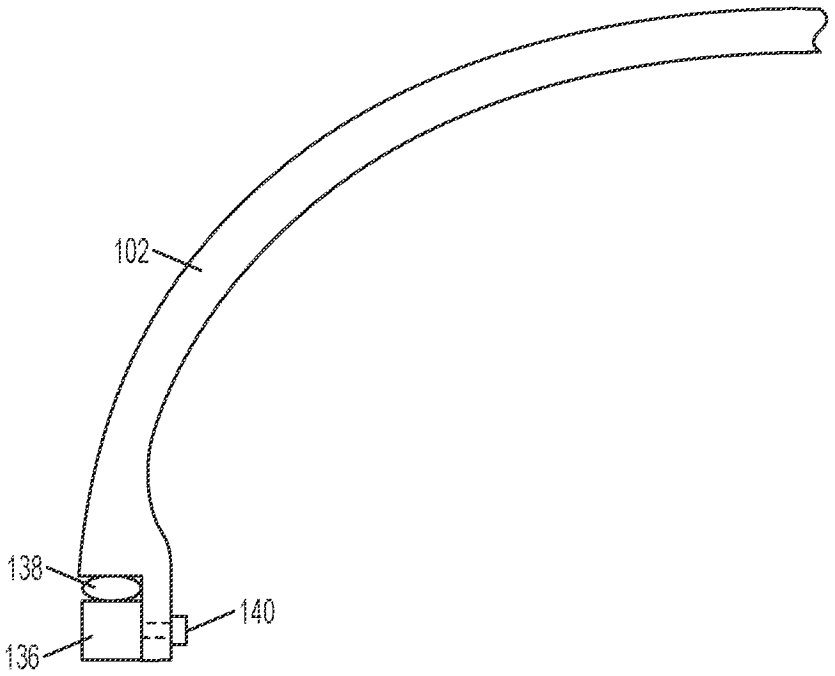
FIG. 13 is a cross-sectional view taken along line 13-13 of FIG. 12.
Figure 14:
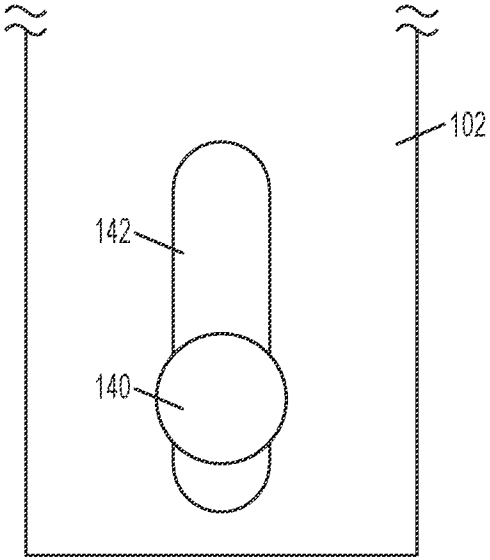
FIG. 14 is a rear view of a portion of the helmet shown in FIGS. 12 and 13.

FIG. 13 shows a cross-section taken along line 13-13 of FIG. 12, and FIG. 14 shows a rear view of certain components. Upper frame member 102 and front frame member 136 are able to move relative to each other, and a stop is provided to prevent the front frame member and the upper frame member from detaching. A bolt 140 or other protrusion is mounted to the front frame member and is slidable within a slot 142 which is connected to upper frame member 102. The bolt 140 prevent the upper frame member from separating from the front frame member, but allows the front frame member and upper frame member to move toward each other while being cushioned by compressible material 138. In some embodiments, a similar arrangement may be employed at the rear of the helmet between the upper frame member and the lower frame member.

In some embodiments, instead of an upper member 102 running along the mid-sagittal plane, there is instead one or more upper members running along one or more coronal planes. Plates are connected to the upper members and one or more lower members that travel along a base of the helmet Similar to other embodiments described herein, resilient, compressible material may be positioned between the plates and the upper and/or lower members.

The rigid or semi-rigid plates may be made of any suitable material or combination of materials. In some embodiments, ABS and/or polycarbonate may be used. A carbon fiber composite material, or any other suitable material may be used to form all or part of the plates.

In some embodiments, plates 104 and/or underlying air bladders 116 have small coverage gaps, such as slits or holes 126 to allow heat or moisture accumulated during physical activity to exit the helmet, while the helmet retains its protective qualities. The holes 126 as shown in FIGS. 1, 2, and 3, or other gaps, may be spaced at various locations on the helmet to allow airflow into and out of the helmet cavity.

In some embodiments, the faceguard 110 includes a small visor attaching member on either side of the frame at approximately a wearer's eye level. An optional visor comprised of clear polycarbonate or any other suitable material may be attached to the helmet with these attaching members.

Figure 15:
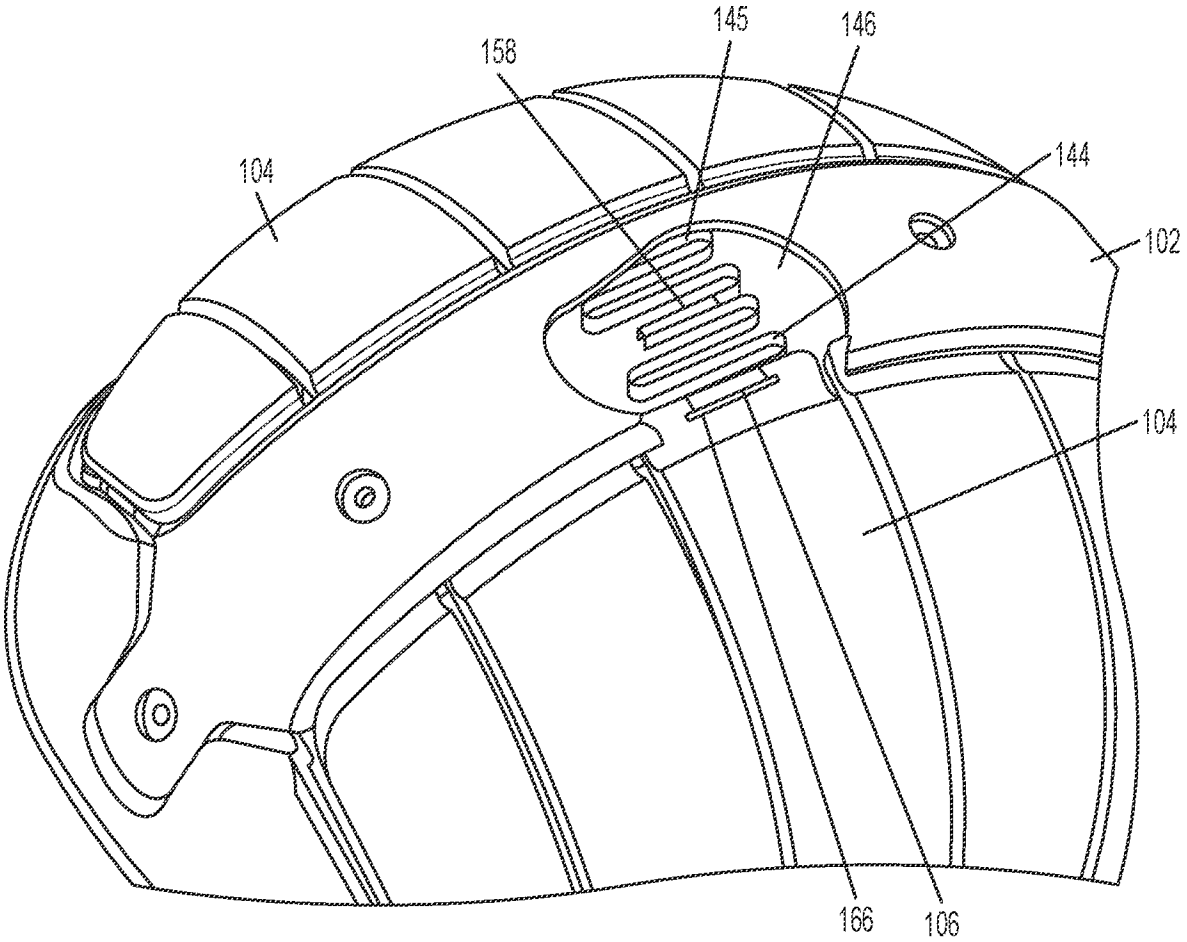
FIG. 15 is a top, front, right perspective view of a helmet according to another embodiment.

In some embodiments, compressible, resilient elements include springs positioned between the plates and the frame member(s). FIG. 15 shows one arrangement where a pair of springs 144, 145 are positioned between opposing plates 104 and the upper frame member 102. In such an arrangement, the springs 144, 145 may absorb some of the force of an impact to the plates 104 by compressing, thereby allowing the plates 104 to move from their original positions relative to the upper frame member 102. When the force is removed, the springs 144, 145 may expand to their original lengths and the plates 104 may move back to their original positions.

The springs 144, 145 may be constructed and arranged such that they can extend. For example, as described above, air bladders within the helmet may expand on a side of the helmet that is opposite to the side of impact. The air bladder expansion may push plates 104 away from the frame member, thereby extending one of the springs. Once the air bladders return to their original arrangements, the spring pulls the plate 104 back to its original position. In some embodiment, the springs 144, 145 allow up to four mm of displacement in either direction (expansion and compression), although other maximum distances are possible. In some embodiments, the maximum possible compression distance may be different from the maximum possible extension distance.

The springs 144, 145 may be separate elements or they may be joined together at a junction 158 using an adhesion, bonding, or any suitable attachment method. In some embodiments, the springs 144, 145 may be a unitary piece of material. The junction 158 can be formed at a single point between the springs or along a length of the springs, as shown in FIG. 15. In one embodiment, the junction 158 is fixed to an inner surface 146 of the frame member and/or an underside of an upper portion of the frame member. The junction 158 may be equidistant between opposing plates 104. In other embodiments, the junction 158 may be positioned closer to one plate so opposing plates 104 may have asymmetric responses to an impact force.

The upper frame member 102 may enclose the springs 144, 145 such that the springs are not exposed. A helmet may include at least two springs, or any suitable number of springs. The springs 144, 145 may be any type of suitable spring, such as a leaf spring or a compression spring, among others. Springs 144, 145 with the same or different properties may be used within a helmet, such as springs with varying lengths, stiffnesses, or shapes. Further, the springs 144, 145 may be formed of any suitable resilient material, such as stainless steel, copper, plastic, and so on. In some embodiments, springs 144, 145 may be positioned between some or all of the opposed plate pairs, and/or at other locations of the helmet.

Figure 16:
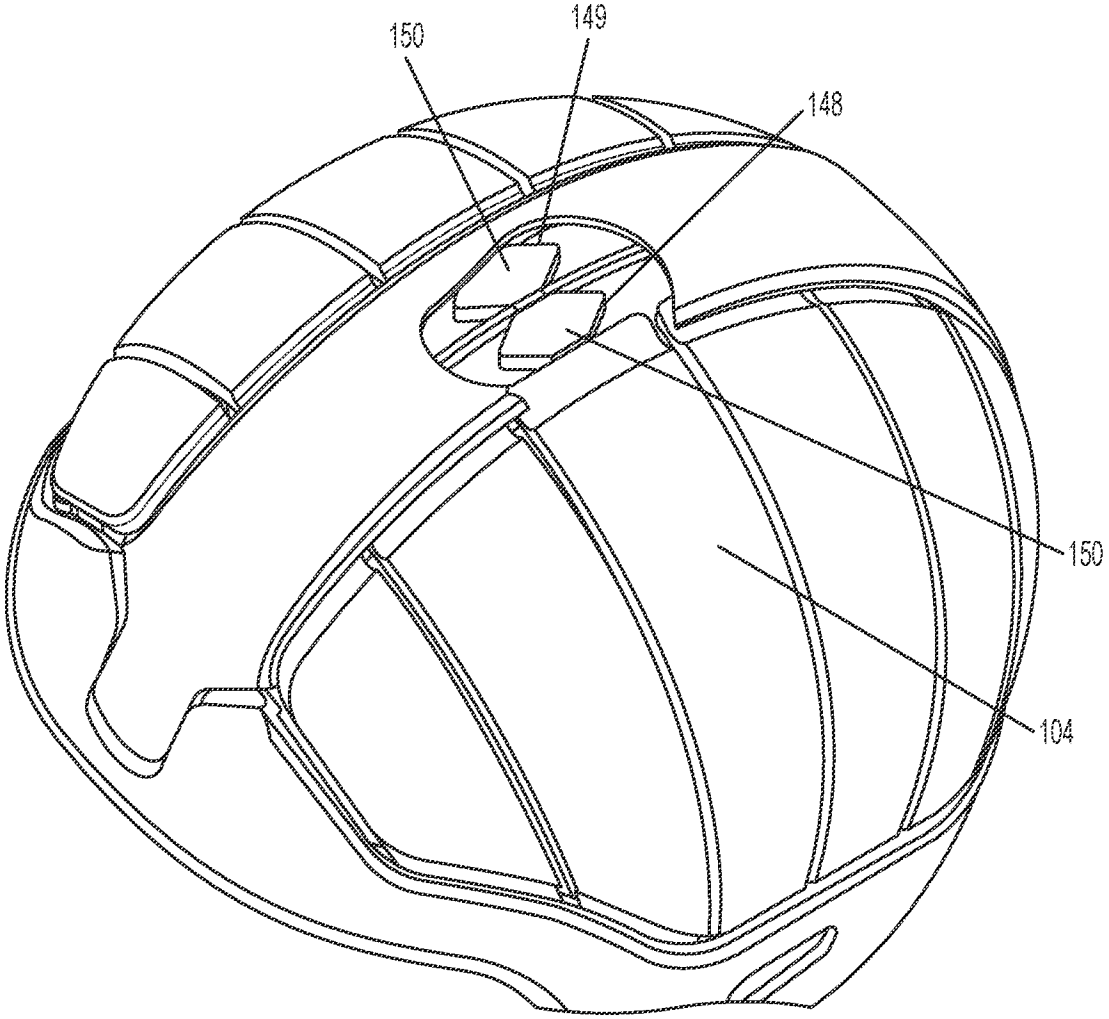
FIG. 16 is a top, front, right perspective view of a helmet according to a further embodiment.

In FIG. 16, another embodiment of a spring arrangement for the helmet system is shown. Each of springs 148, 149 is in the shape of an irregular hexagon which allows expansion and compression. Each spring 148, 149 surrounds an area that may hold a resilient material insert 150. The resilient material insert 150 may be foam or a compressible bladder filled with gas. In some embodiments, the foam may be a memory foam such as a polyurethane memory foam. When one or both of the springs 148, 149 are compressed due to impact on the plate 104, compression of the resilient material insert 150 absorbs part of the impact. When the impact force is removed, the resilient material insert 150 expands to push its surrounding spring outward, helping return the spring and the plate 104 to their original positions quickly. In some embodiments, the resilient material insert 150 is sized and shaped to match the inner walls of the spring 148, 149. In some embodiments, the resilient material may be a different shape or size than the spring 148, 149 when the resilient material insert 150 is removed from the spring 148, 149.

Figure 17:
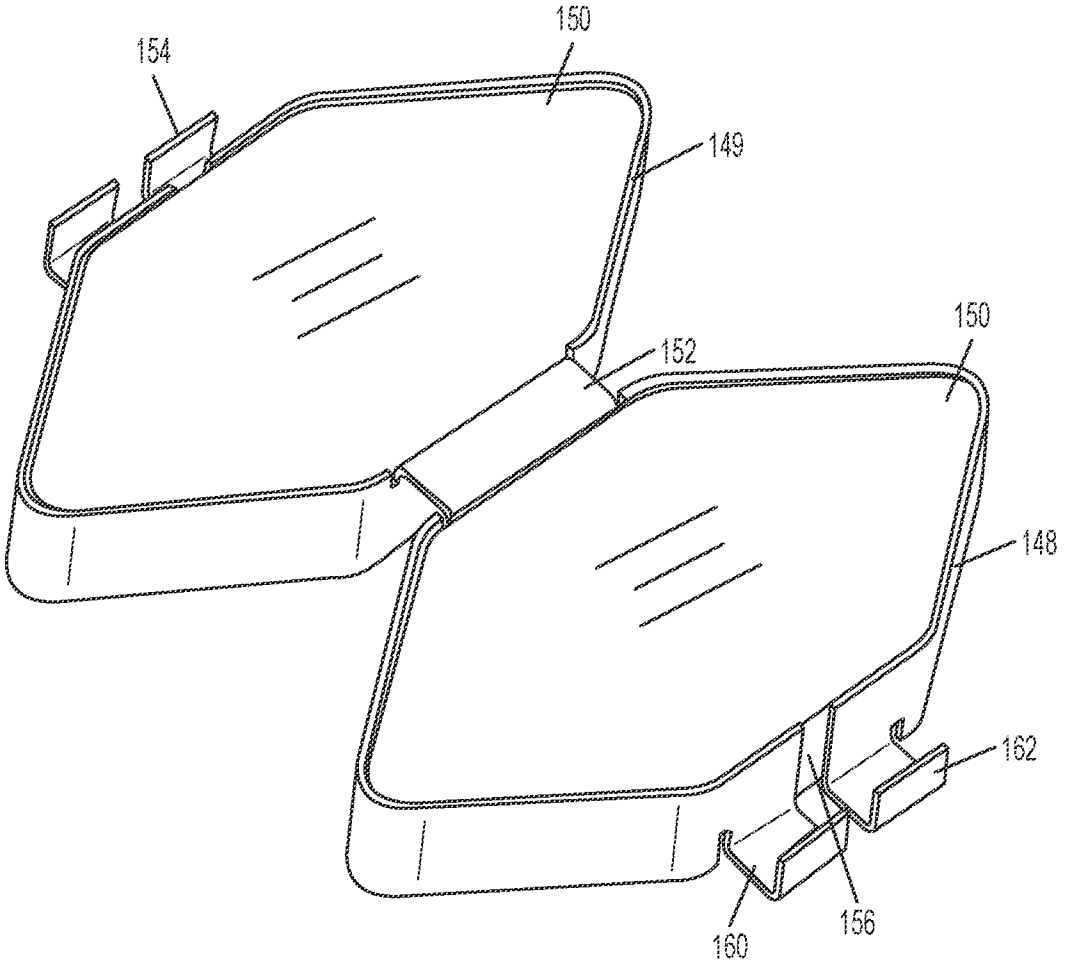
FIG. 17 is a top, front, right perspective view of the springs shown in FIG. 17.

FIG. 17 is a magnified view of the springs 148, 149 and resilient material inserts 150 shown in FIG. 16. The resilient material inserts 150 may be adhered or otherwise suitably attached to the springs 148, 149 such that when a spring 148, 149 extends, the resilient material insert 150 is stretched and tends to pull the spring 148, 149 back toward its original position. The resilient material insert 150 is not covered on its top surface by the spring 148, 149, but in some embodiments, a protective cover and/or further spring elements may be included over the top of the resilient material insert 150.

Spring 148 is shown as not entirely surrounding the perimeter of the resilient insert 150. In particular, spring 148 has a gap 156 between hooks 160, 162. In some embodiments, some or all of the springs may have gaps, or all of the springs may not have gaps. Gap 156 may allow the spring 148 to expand to facilitate placement of the resilient material insert 150 in the spring 148. The opening 156 also may improve the compression and expansion of the spring 145.

A bridge 152 connects adjacent sides of spring 148 to spring 149. The bridge 152 may be formed of the same material as the springs 148, 149, or may be made of a different material. A protrusion from the helmet body may fit between springs 148, 149 and under bridge 152. With such an arrangement, the inner portions of the springs 148, 149 are fixed relative to one another.

FIG. 17 also shows attachment features such as hooks 160, 162 that attach the springs 148, 149 to the plates 104. In the illustrated embodiment, the hooks 160, 162 fit into a corresponding slot on the plate 104, similar to the slot 166 shown in FIG. 15. In other embodiments, the spring 148, 149 may attach to plates 104 at a single point, along a length of the plate 104, or at multiple points. The attachment may be configured to distribute the spring force symmetrically across the plate 104. In some configurations, however, it may be desirable to have an asymmetric distribution of spring force across the plate 104. As will be appreciated, any suitable attachment method can be used between the spring 148, 149 and plate 104, including but not limited to welding, screws, rivets, adhesives, fasteners, and integral formation.

Figure 18:
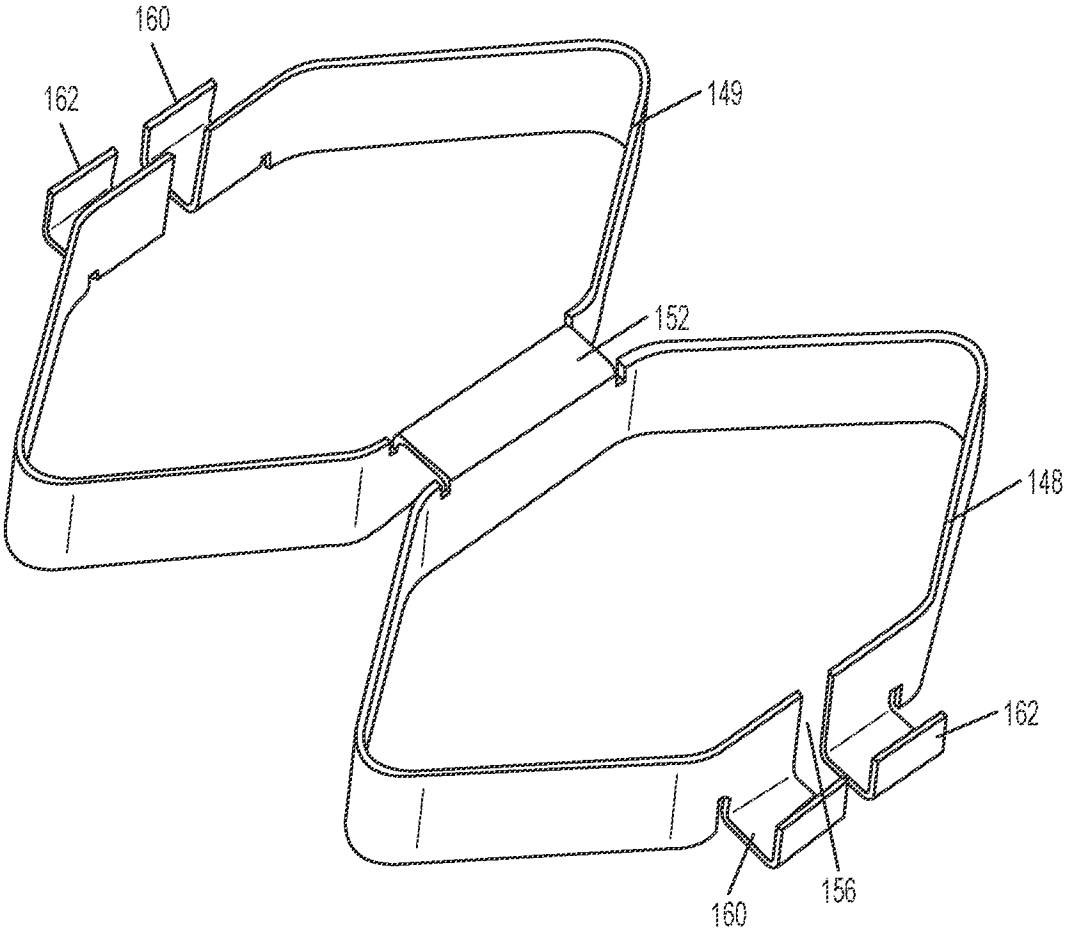
FIG. 18 is a top, front, right perspective view of a spring arrangement according to another embodiment.

FIG. 18 shows an alternative embodiment of a six-sided spring 148, 149 without a resilient material insert 150. In some embodiments, a helmet may include springs 148, 149, such as the springs 148, 149 disclosed herein, which are encased within a resilient material. For example, a resilient foam may be molded around a spring 148, 149 in some embodiments.

Figure 19:
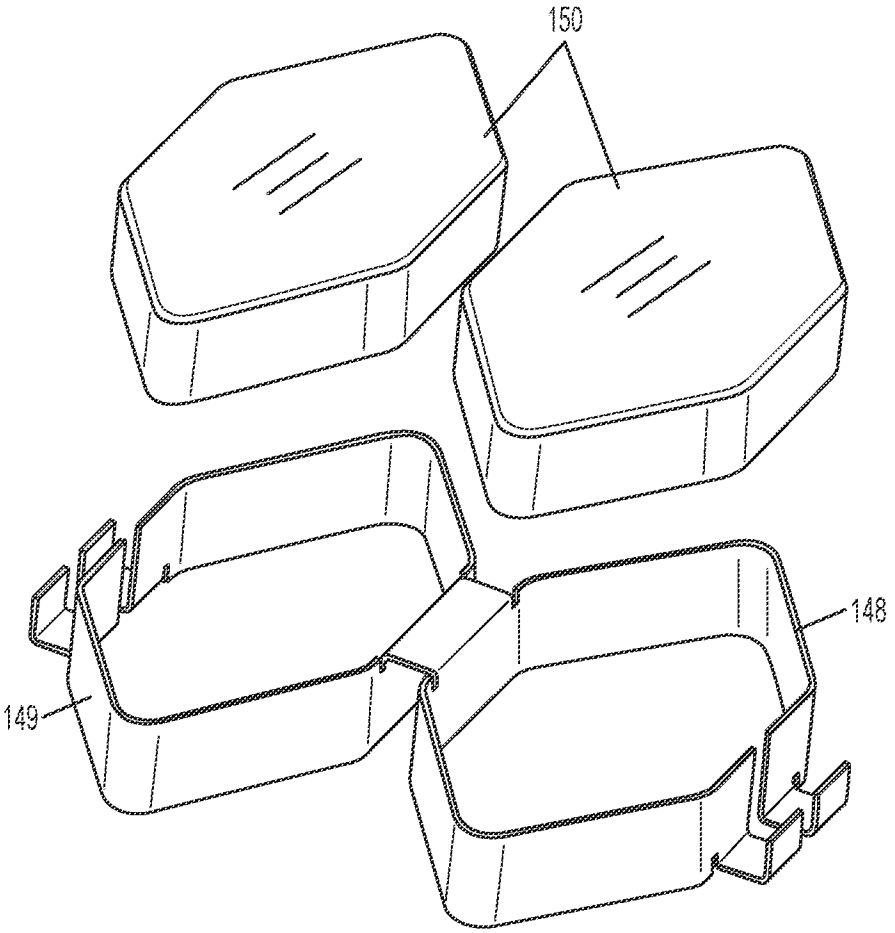
FIG. 19 is an exploded view of resilient, compressible inserts and springs according one embodiment.

In FIG. 19, resilient material inserts 150 are shaped to fit the springs 148, 149 and are removable from the springs 148, 149. As described above, the resilient material insert 150 may or may not be attached to its respective spring 148, 149, for example with an adhesive or in any other suitable manner. In some embodiments, the resilient material insert 150 may be attached to only a portion of a spring 148, 149. In one embodiment, the resilient material insert 150 is attached to a spring 148, 149 on the three spring walls opposite the bridge 152. In another embodiment, a resilient material such as foam encases the spring 148, 149. Multiple springs 148, 149 may be encased in a single piece of resilient material, or each spring 148, 149 may be individually encased in resilient material.

Although six-sided springs 148, 149 are shown, springs with any suitable dimension and/or ratio of side lengths may be used. Other spring geometries may also be used, such as springs with different numbers of sides, including but not limited to four- and eight-sided springs.

Figure 20:
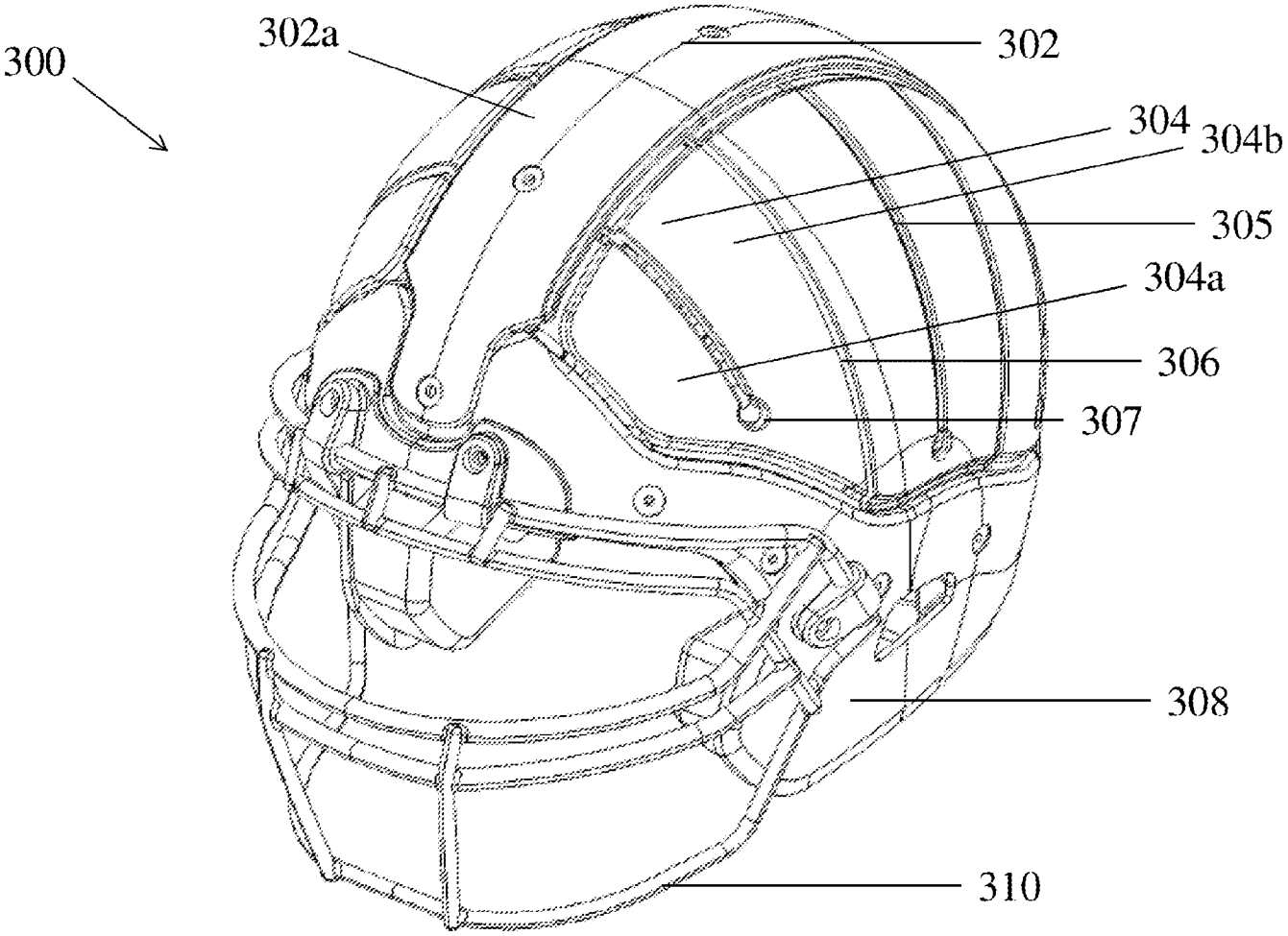
FIG. 20 shows a football helmet according to another embodiment.
Figure 21:
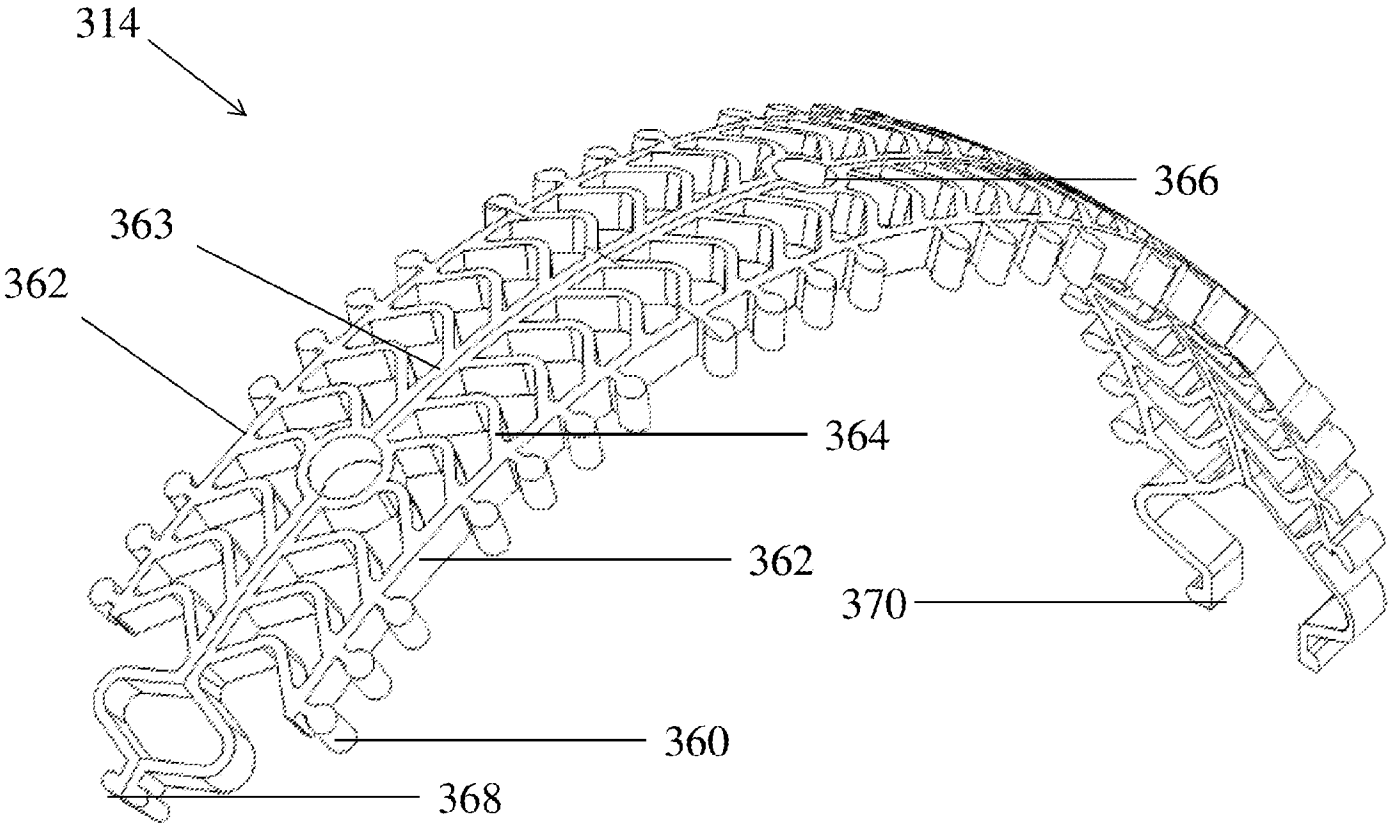
FIG. 21 shows a top, front, right side perspective view of a compressible material according to one embodiment.
Figure 22:
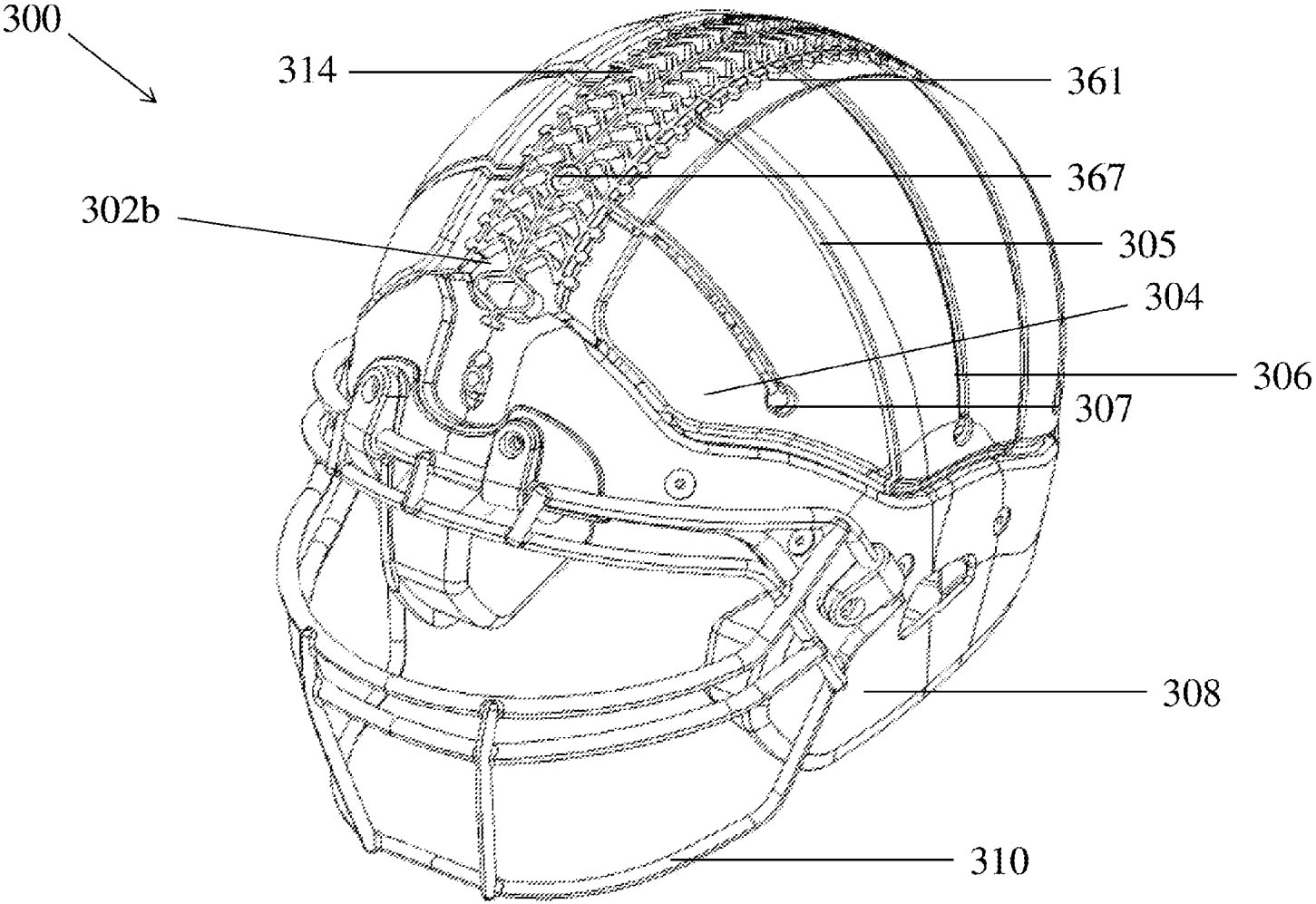
FIG. 22 is a top, front, right side perspective view of the helmet of FIG. 20 with an upper panel removed so that the compressible material is exposed.
Figure 23:
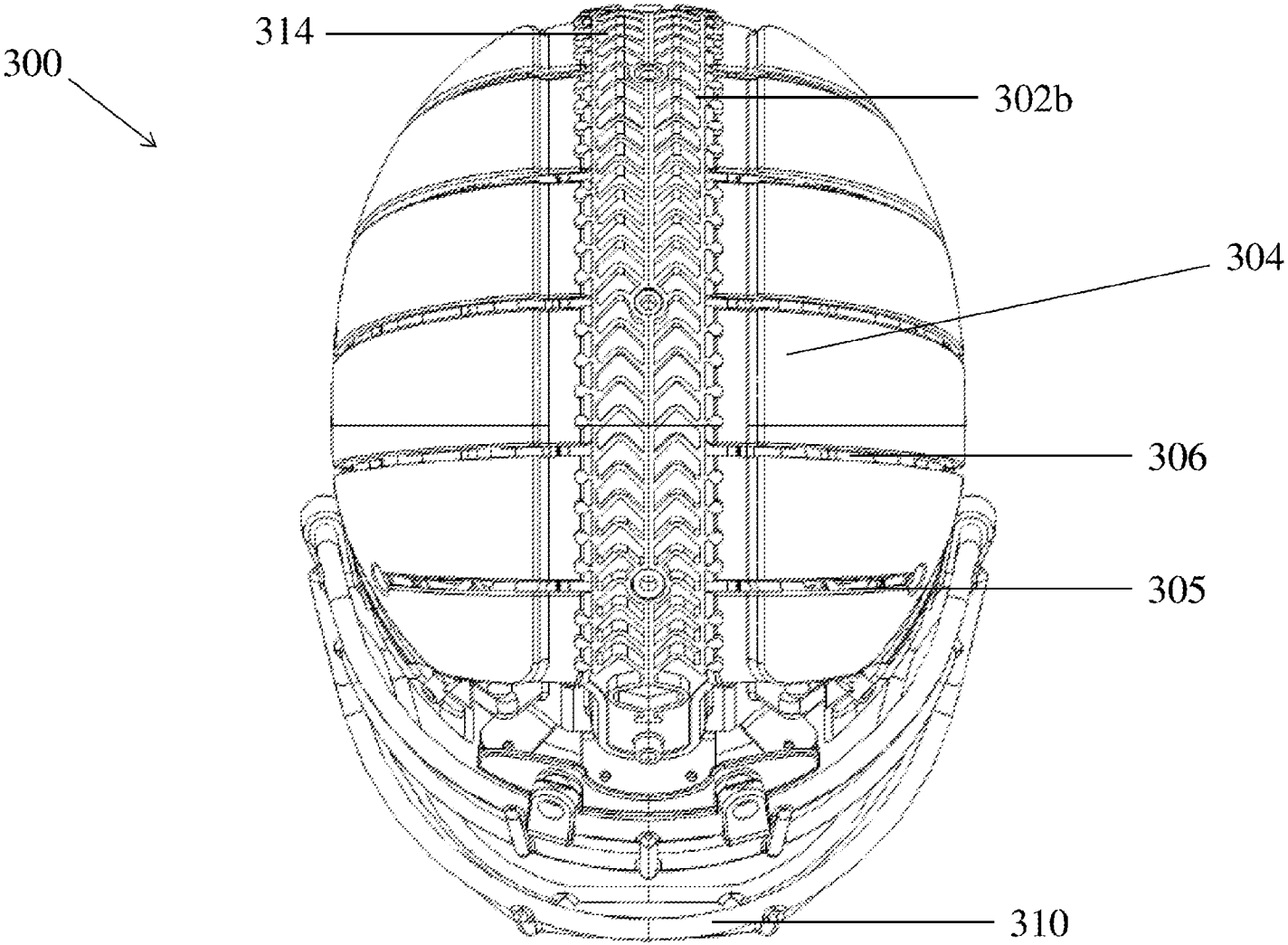
FIG. 23 is a top view of the helmet of FIG. 20.
Figure 24:
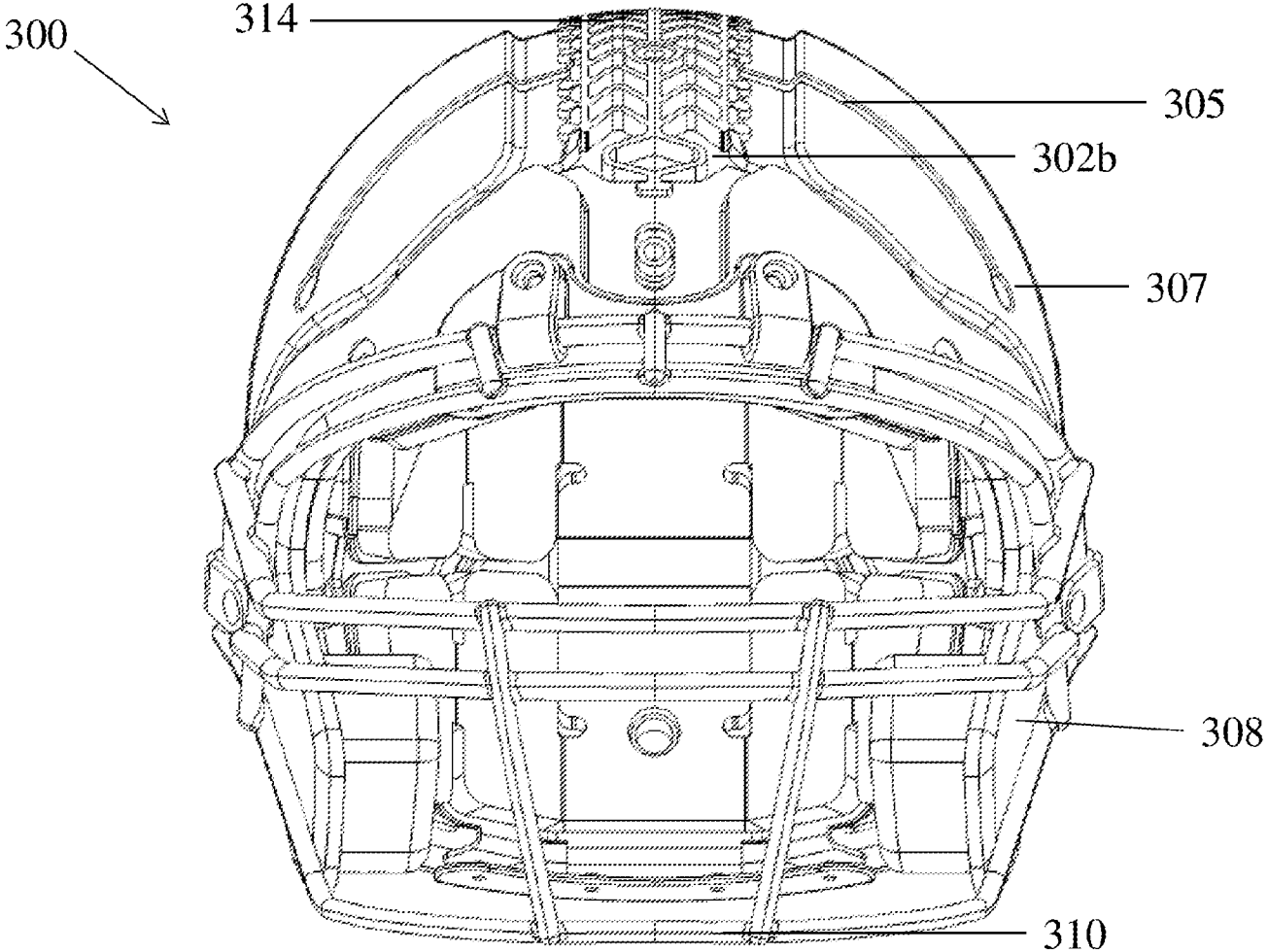
FIG. 24 is a front view of the helmet of FIG. 20.

FIG. 20 shows a helmet 300 with plates that are movable relative to each other. In this embodiment, plates 304 are separated by gaps 306, and are attached to an upper member 302. Gaps 306 allows the plates 304 to move relative to each other for energy dissipation upon impact as described above. In this embodiment, plates 304 are further split further into two elongate fingers joined at the bottom of the plates where they moveably attach to a lower member 308. The depicted embodiment has a single continuous lower member 308, but other embodiments may have lower members that are formed with of multiple pieces. The two elongate fingers 304*a* and 304*b* are separated by slots 305, which end in a circular hole 307 such that the elongate fingers are free to move slightly relative to each other (though constrained by upper member 302 and the lower end of plate 304). Circular hole 307 provides stress release at the junction of the two elongate fingers. While the depicted embodiment shows two elongate fingers per plate, other embodiments could have more divisions of each plate, or could have differing numbers of sub-divisions per plate. In some embodiments, some or all of the plates do not have fingers, and simply include a single piece plate. The depicted embodiment also shows three plates for each lateral side of the head, but differing numbers of plates comprising the outer shell of the helmet are also contemplated.

As with earlier embodiments, upper member 302 of helmet 300 spans or partially spans the shape of the head from front to back, and lower member 308 extends from the rear base of the helmet and along both jawlines. However, each of the upper and lower members could comprise multiple segments in other embodiments, or could be wider or thinner, thicker or thinner, and in general are not limited to the arrangements depicted.

FIGS. 21-26 show a compressible material 314 according to some embodiments of the helmet. In these embodiments, compressible material 314 is housed between an upper and lower housing section 302*a* and 302*b* of upper member 302. The compressible material 314 includes two outer rails 362 and an inner rail 363 attached together with v-shaped chevrons 364 running between the rails. Chevrons 364 are shaped to dissipate impact energy as described below. Some embodiments have two rails joined together at the center to join the two sections of chevron shapes (or other intermediate shapes). Other embodiments have the two sections of chevron shapes attached to a section of upper member 302 spanning between the two. Ends 368 and 370 of compressible material 314 attach to corresponding features on the helmet. To maintain positioning of the compressible material element, circular gaps 366 are intermittently positioned along the center of compressible material 314 and capture corresponding cylindrical protrusions 367 extending from the bottom housing section 302*b* of upper member 302, as seen in FIGS. 22-25. This arrangement prevents compressible material 314 from substantially shifting. Interlocking members 360 line lateral rails 362 and interlock with interlocking features 361 of the plates 304 to keep the plates attached to the compressible material.

Figure 25:
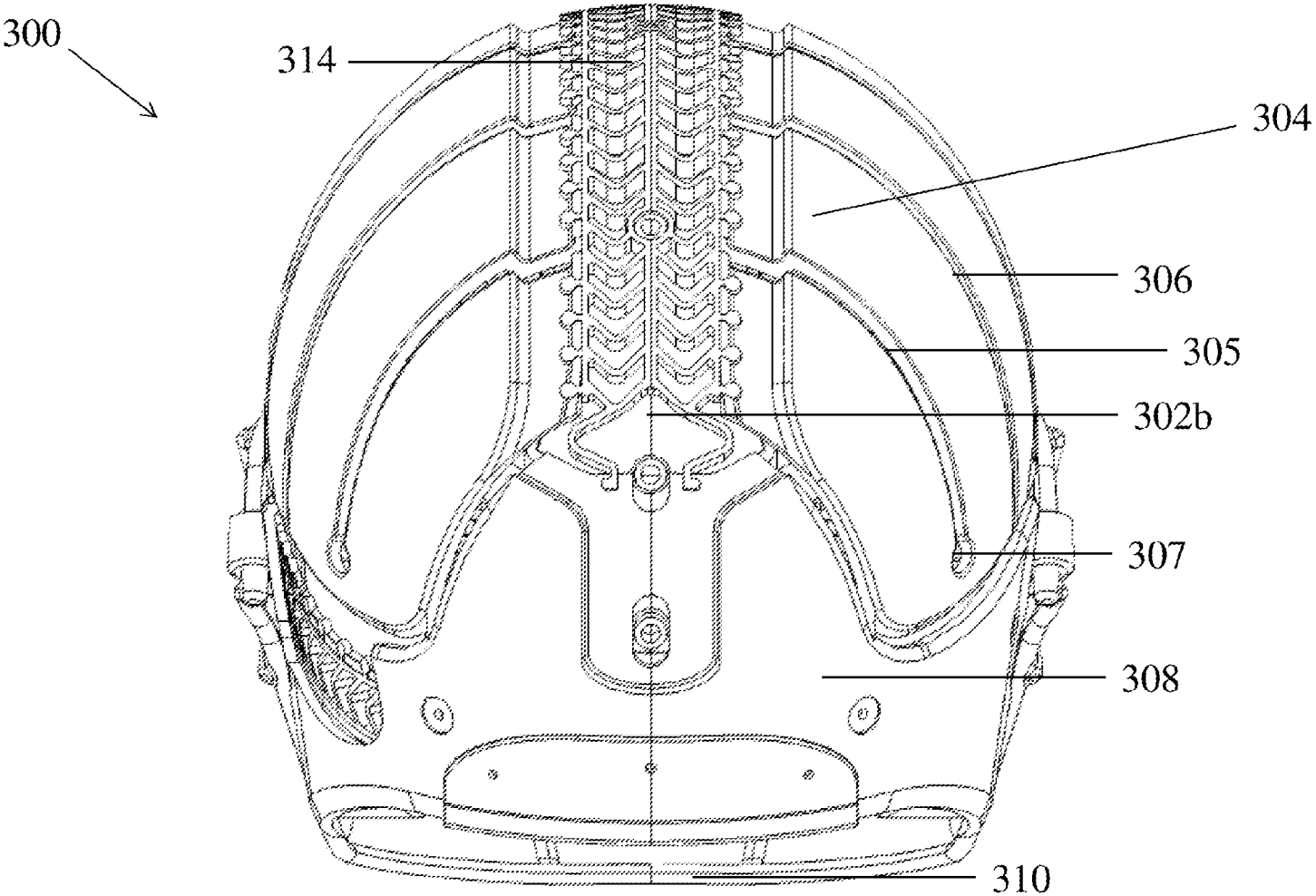
FIG. 25 is a rear view of the helmet of FIG. 20.
Figure 26:
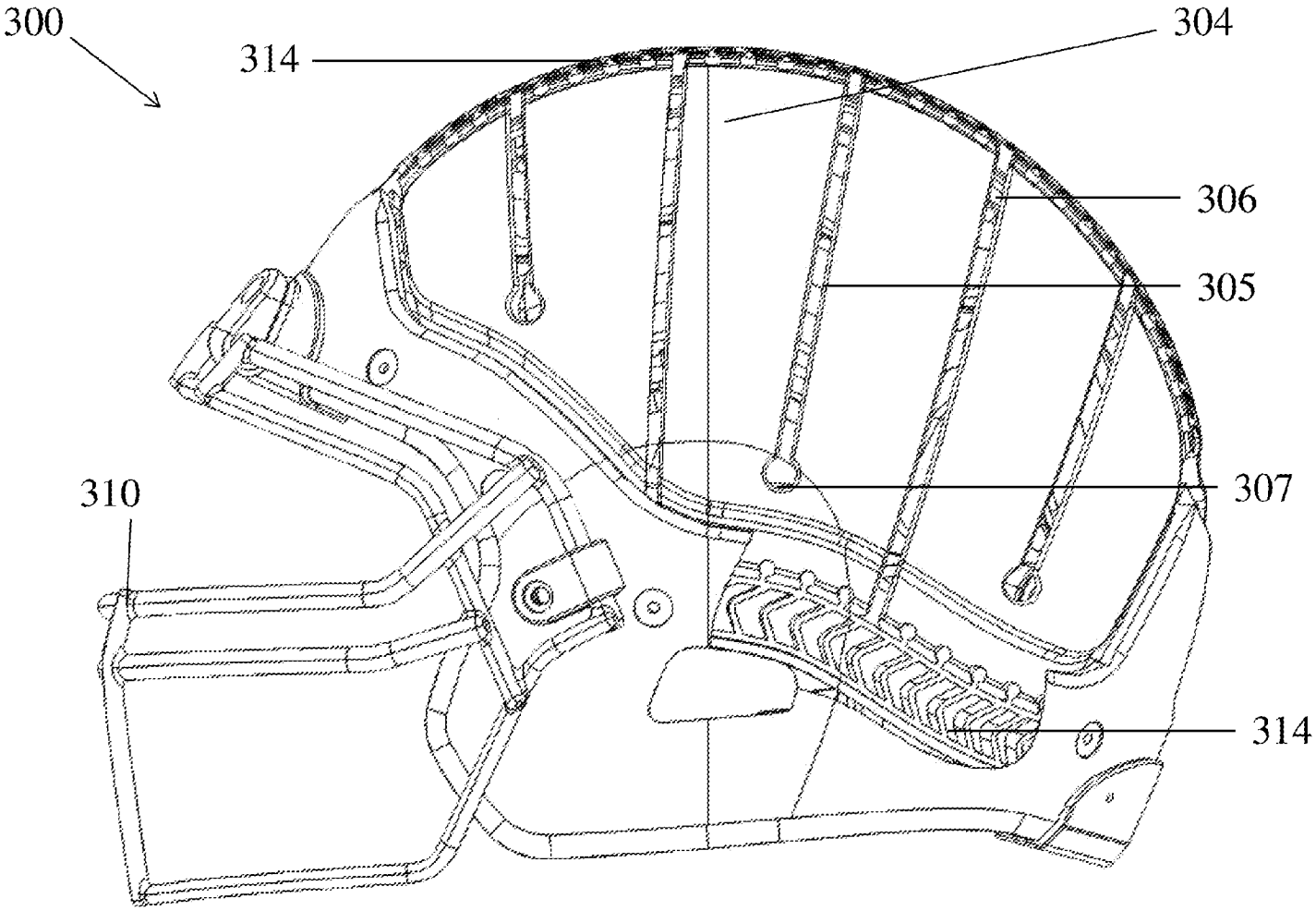
FIG. 26 is a side view of the helmet of FIG. 20.

In some embodiments, for example those shown in FIGS. 25 and 26, compressible material 314 is also included inside the lower member 308, interconnecting in a similar manner with the bottom of plates 304.

While compressible material is depicted a certain configuration in the figures, it should be understood that it is not limited as such. Interlocking members 362 may be of any shape that allow them to interlock or otherwise attach to plates 304. Dovetail shapes, bulbs, T-shapes, Y-shapes, triangular protrusions, or other interlocking shapes are also contemplated. Instead of interlocking members, the compressible material may be attached to plates 304 using fasteners, springs, adhesives or other attachment arrangements. Embodiments with more or fewer rail sections are also contemplated.

Compressible material 314 can be made of any suitable foam, rubber, synthetic rubber, silicone, urethane, neoprene, nitrile, thermoplastic elastomer, set foam, formable foam, set elastomer, formable elastomer, latex, or other suitable material, or a combination thereof.

Energy dissipating connectors having inner shapes other than chevrons may be used. For example, diamond shapes, zig-zag shapes with varying numbers of teeth, saw-tooth shapes, ovoid shapes, circular shapes, or other suitable shapes may be used. A solid piece of compressible material may be used in some embodiments.

The present disclosure is not limited to circular holes and circular protrusions for attachment of the compressible material to the upper member and could instead use fasteners including staples, screws, bolts, nails, or other similar penetrating fasteners, adhesives, or compression between the upper and lower housing sections of the upper member to maintain the position of compressible material 314.

When a plate 304 sustains an inward impact, several responses may help dissipate and/or distribute energy. If the impact is focused on one of the elongate fingers, that finger may reversibly deform and dissipate energy. The finger shifts inwardly with the force of the impact, deforming the air bladder 172 below the shell, further dissipating energy. Air in the air bladder is forced into other compartments, causing them to inflate and push other plates outwards, further dissipating energy. Additionally, the inward movement of plate 304 reversibly deforms compressible material 314, causing the chevrons 364 near the plate to compress. The expanding air bladders cause other plates 304 to expand outwardly, thereby producing a pulling force on the attached chevrons 364 which stretches the chevrons and dissipates energy.

In this manner, compressible material 314 may form a spine along a top center of the helmet. In some embodiments, the spine permits movement of the discrete plates relative to each other, while also limiting the overall movements of the plates. The spine may facilitate the dissipation and distribution of impact energy in one or more of the manners described above.

In some embodiments, the helmet does not have an upper member, or the has an upper member but the rigid or semi-rigid plates do not translate relative to the upper member.

Figure 27:
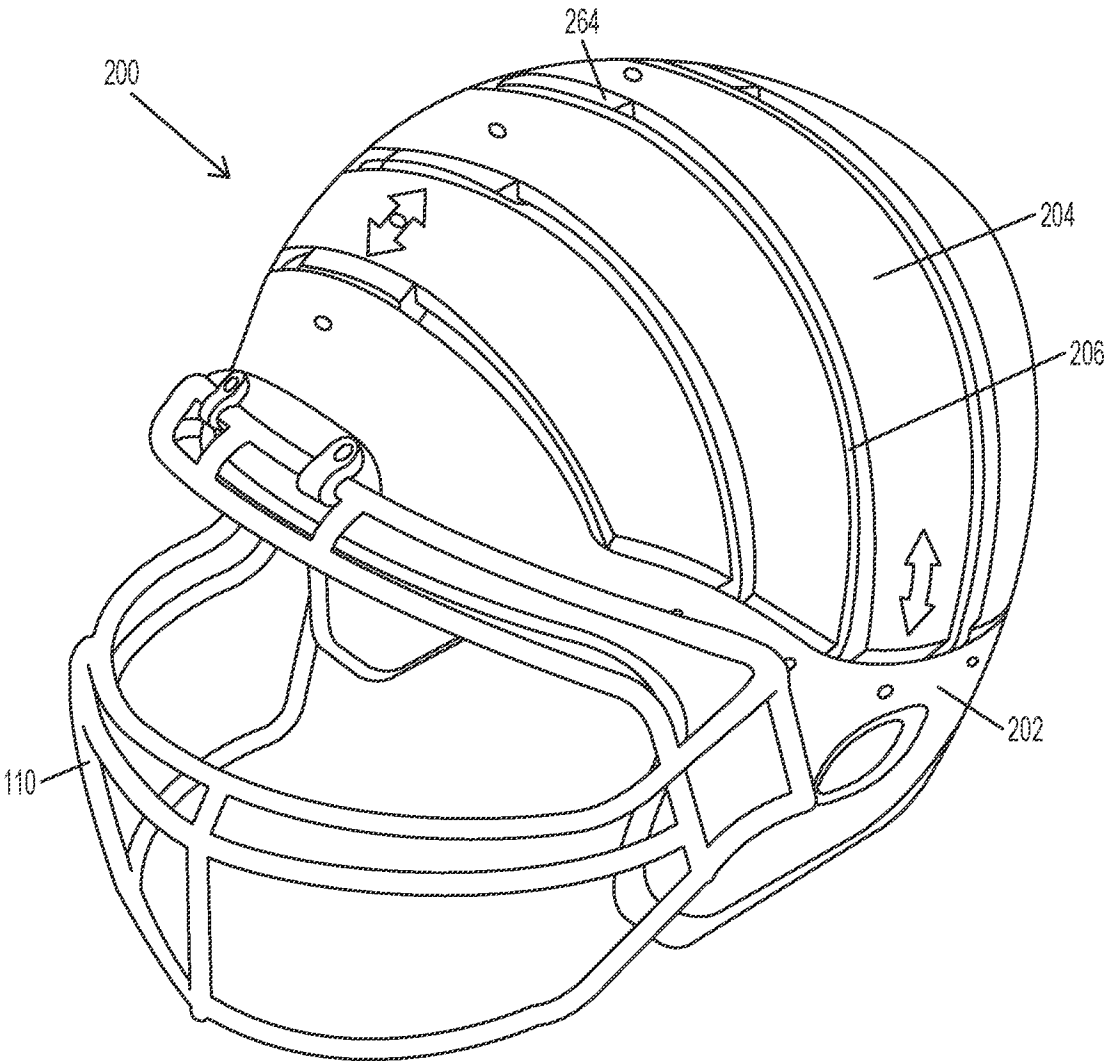
FIG. 27 shows a football helmet according to another embodiment.

For example, as shown in FIG. 27, the helmet 200 includes a frame member, such as a lower frame member 202 that spans a user's head from the frontal region to the upper cervical region running down the outside of the face and in the dorsal direction along both jawlines, ending at the base of the skull. In some embodiments, faceguard 110 is attached to the ventral side of the frame member. In various embodiments, different types of plates may be attached directly or indirectly to the frame member 202, or may integral to the frame member 202. The frame member 202 may be made of any suitable polycarbonate, metal, hard plastic, or any suitable material or combination of materials to maintain the integrity of the helmet.

Rigid or semi-rigid plates 204 in the embodiment of FIG. 27 are U-shaped and travel from one side of the helmet to the other side, passing over the crown of the helmet. Gaps 206 may be present between the plates 204, though gaps may not be present in some embodiments. The gaps may have a width that is smaller than a typical human finger to help prevent fingers from penetrating the helmet or getting caught in the gaps. In some embodiments, gaps 206 may be 1 cm or less.

The plates 204 may be attached at their ends to frame member 202 via compliant connections. The plates may be movable relative to the frame member 202 in the longitudinal direction of the ends of the plates to a limited extent. For example, the plates may be attached to the frame member via one of the various connections described herein.

Compliant spacers 264 may be positioned between the plates and/or between a plate and the structural member 202 along a front-to-back mid-line of the helmet. The compliance of the spacers 264 allows the plates to shift forward and backward. In other embodiments, the spacers may be rigid and not allow forward and backward movement, and may be slidingly engaged to the plates so that the plates can move side-to-side on the helmet. The compliant spacers 264 may be formed from any flexible material that allows the plates 204 to reversibly shift frontwards or backwards by deforming the spacers 264 upon impact to the helmet. The plates 204 may be made of any suitable polycarbonate, metal, hard plastic, or any suitable material or combination of materials to maintain the integrity of the helmet. The spacers 264 may be located at positions other than the mid-line. For example, two spacers may be positioned between two given plates 204—one spacer on each side of the mid-line.

Figure 28:
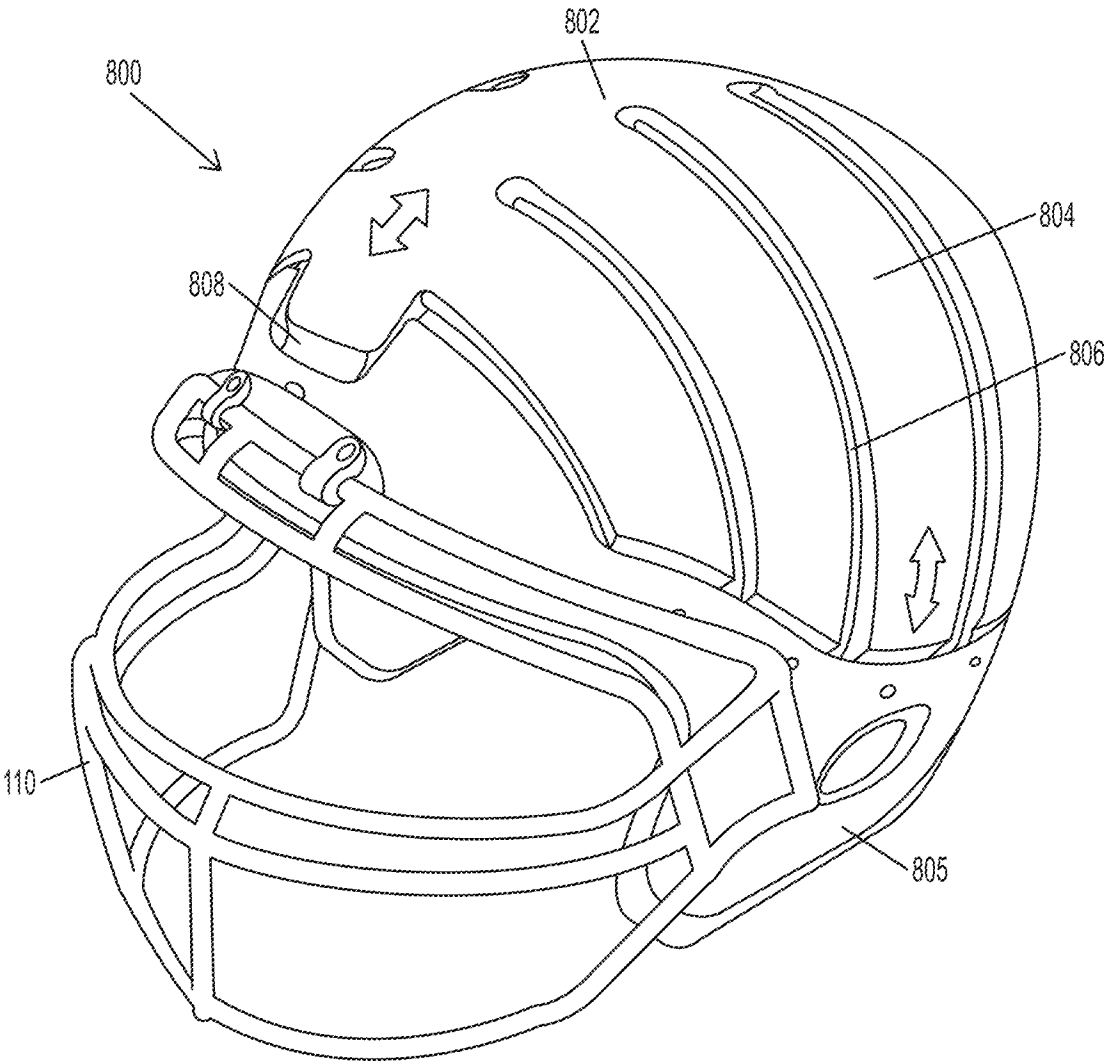
FIG. 28 shows a football helmet according to another embodiment.

In FIG. 28, a helmet 800 with plates 804 integrally connected to a central arch 802 is illustrated. As with many of the other embodiment described herein, the plates may be movably attached at their ends to member 805. Gaps 806 may be provided between the plates to allow the plates to move toward and away from the wearer's head and/or to flex toward or away from adjacent plates. The gaps may be 1 cm or less in some embodiments, though any suitable size may be used. In some embodiments, while there may be a gap present at an outer surface of the plates, an inner surface of the plates and/or interior padding may close the gap so that there is no clear opening to the inside of the helmet. In some embodiments, no gap or a very small gap on the order of 1 mm may be present.

The combined structure of the central arch 802 and plates 804 may move front to back in some embodiments. For example a compliant member or sliding connection 808 may be positioned at a front end of the central arch 802 between the central arch and the frame member 805. Such a connection also may be located along a forward edge of the forward most plates 804 between the plates and the frame member 802.

When the helmet 800 is impacted, the central arch and/or the plates may shift and reversibly deform the connections, thus dissipating impact energy. The central arch and plates may be made of any suitable polycarbonate, metal, hard plastic, or any suitable material or combination of materials to maintain the integrity of the helmet.

Figure 29:
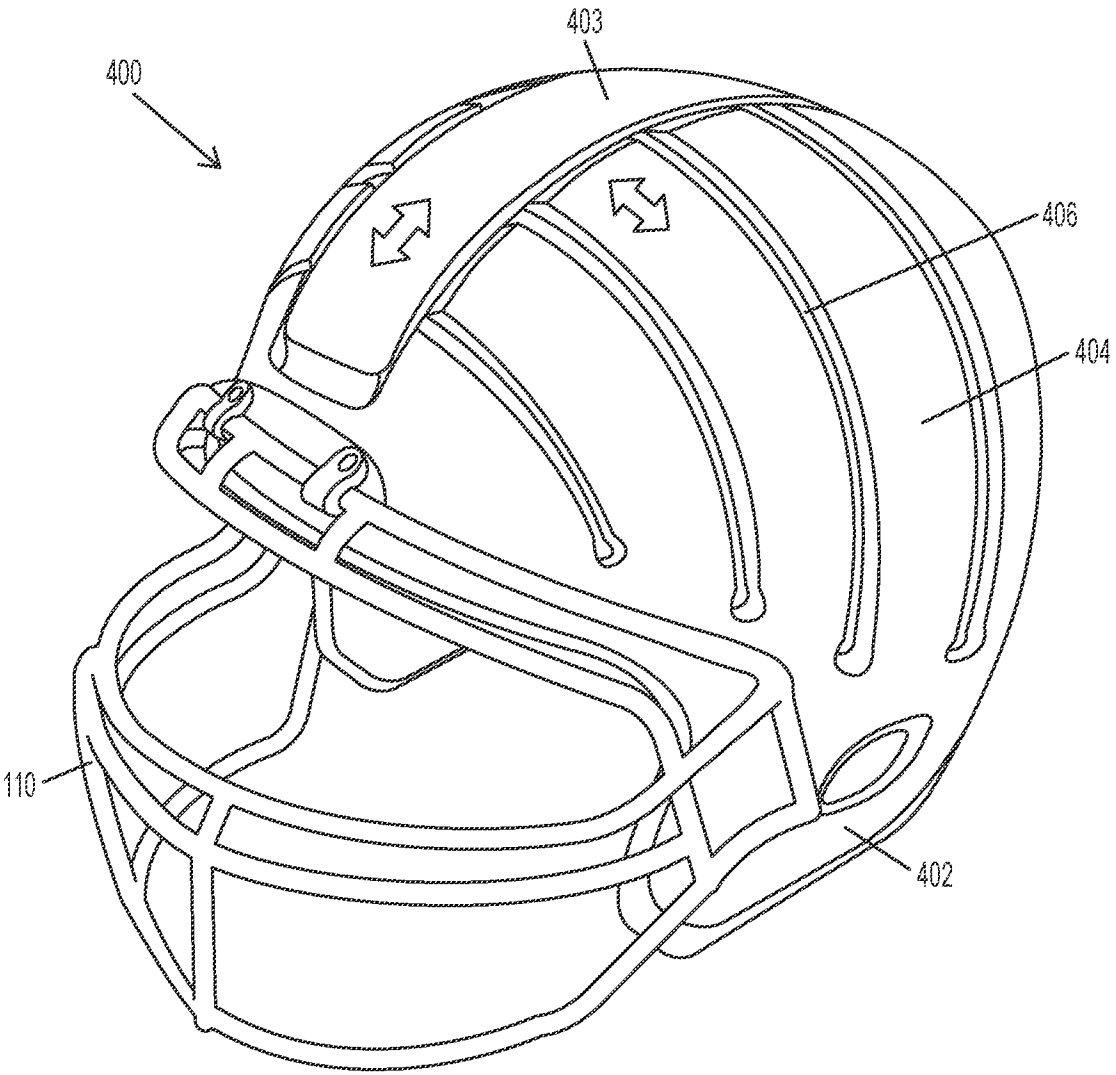
FIG. 29 shows a football helmet according to another embodiment.

In the embodiment illustrated in FIG. 29, a helmet 400 includes a frame member 402 including rigid or semi-rigid plates in the form of integrally extending fingers 404 that travel upwardly on the helmet. At their top ends, the fingers 404 may be slidingly engaged with a central arch 403. The fingers 404 may be slidingly engaged such that the fingers can move toward and away from the central arch. Additionally, the central arch 403 and the fingers 404 may be slidingly engaged so that the central arch 403 can move forward and backward on the helmet.

The fingers 404 may be separated from each other by gaps 406, for example, gaps of 1 cm or less. Or, in some embodiments, there may be no gap, or a small gap on the order of 1 mm. At ends of gaps 406, a rounded end may be provided, in some cases with a diameter larger than the slot width, to reduce stress concentrations and/or to allow more flexibility of the fingers 404 relative to the support member 402.

Figure 30:
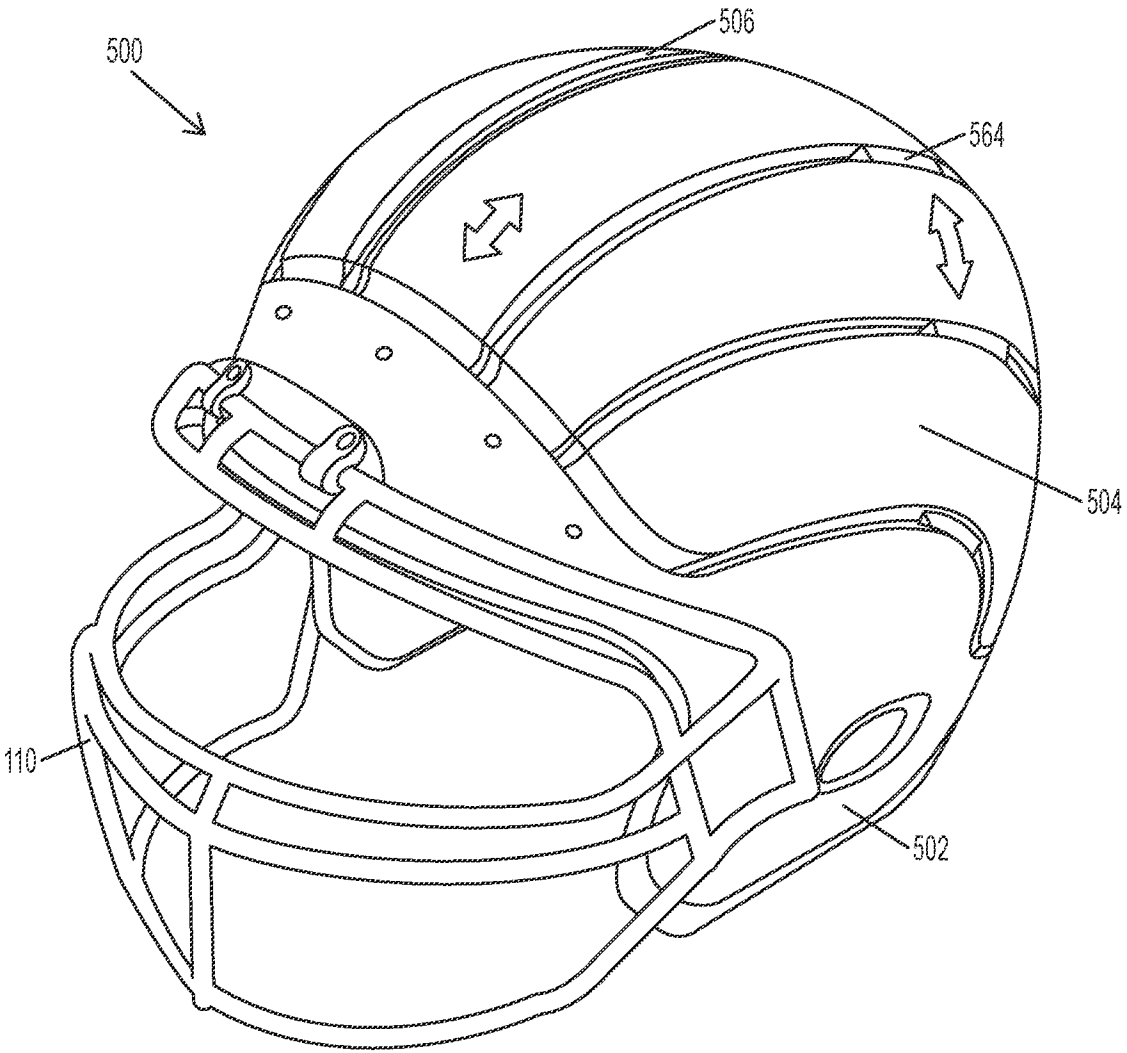
FIG. 30 shows a football helmet according to another embodiment.

According to another embodiment of a helmet 500, plates 504 may be oriented in a forward-backward direction, as shown in FIG. 30. The panels may be connected to a frame member 502 at the front and back of the helmet via compliant connections such that impact to the helmet 500 allows the panels to shift from front to back. The panels 504 are spaced from each other by gaps 506, which in this embodiment also run from front to back. The gaps may be 1 cm or less in some embodiments. Spacers 564 may be provided between the panels, and may be compliant or rigid. With compliant spacers, the plates can move from side to side as the spacers deform upon impact to sides of the helmet 500. The compliant spacers 564 may be formed from any suitable material, including materials that are resiliently flexible. In some embodiments, the compliant spacers include sufficient material to prevent adjacent plates from "bottoming out" under typically-experienced forces.

The spacers 564 may be configured such that the plates 504 can slide past the spacers. In some embodiments, each spacer may be non-slidingly attached to one adjacent plate but not the other. In other embodiments, one or more of the spacers may be non-slidingly attached to both adjacent plates.

Figure 31:
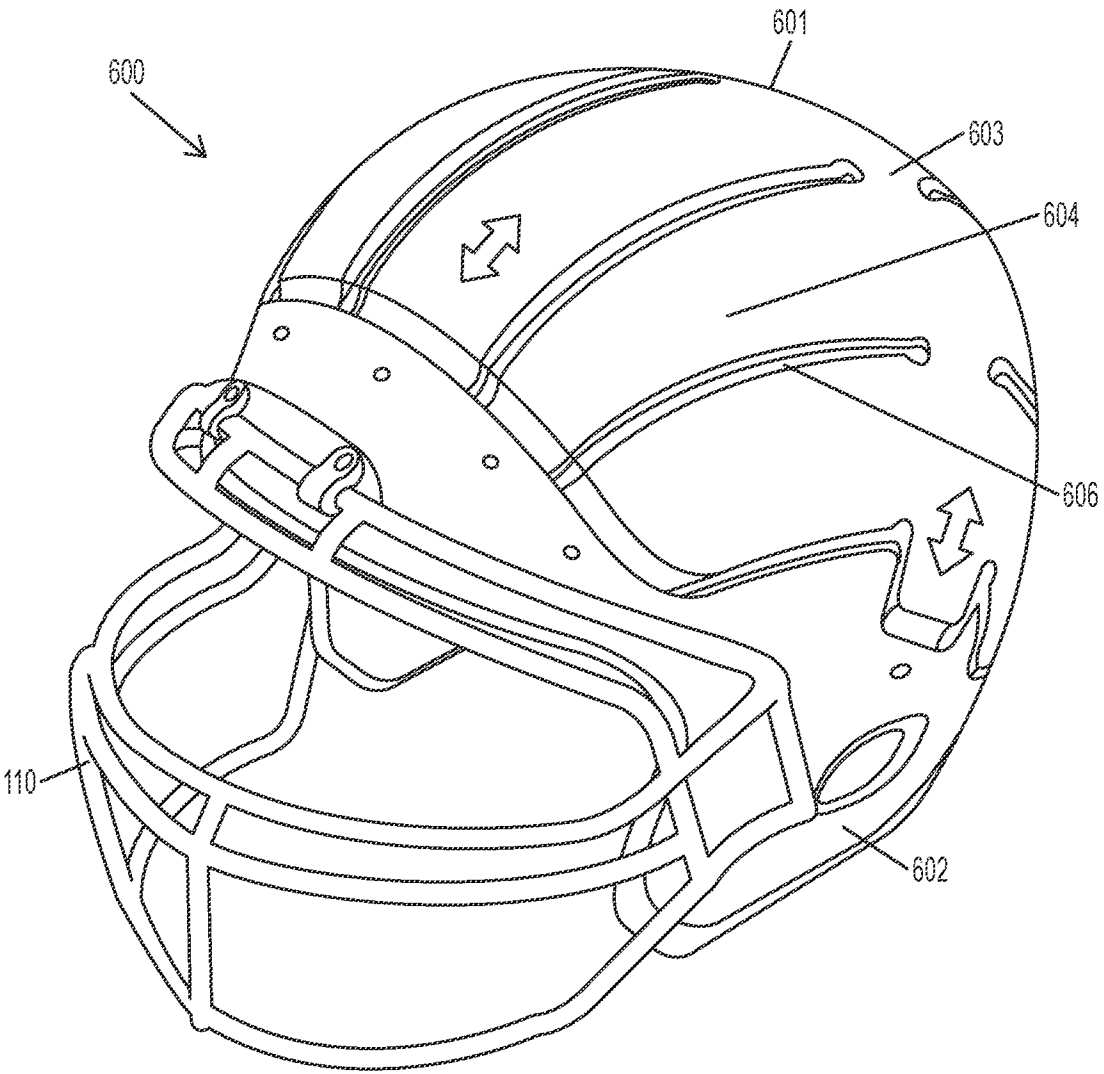
FIG. 31 shows a football helmet according to another embodiment.

The embodiment shown in FIG. 31 includes an integral top component 601 which includes a central section 603 spanning the mid-coronal line of the helmet 600 with panels formed as fingers 604 branching off at points along its span. The fingers may be arranged such that separations (e.g., gaps 606) are substantially equidistant. In other embodiments, the separations may be present at differing intervals. Similar to various other embodiments disclosed herein, the gaps may be sized to prevent fingers from entering the gaps. In some embodiments, the gaps are 1 cm or less at the outer surface of the panels.

The panels 604 travel dorsally or ventrally to form a portion of the helmet's outer shell and connect to the frame member 602 via compliant connections at the front and back of the helmet. The central section 603 connects to the frame member 602 via compliant connections at lateral ends of the central section 603. The panels may move front to back and/or upwardly and downwardly relative to a front section of frame member 602.

Figure 32:
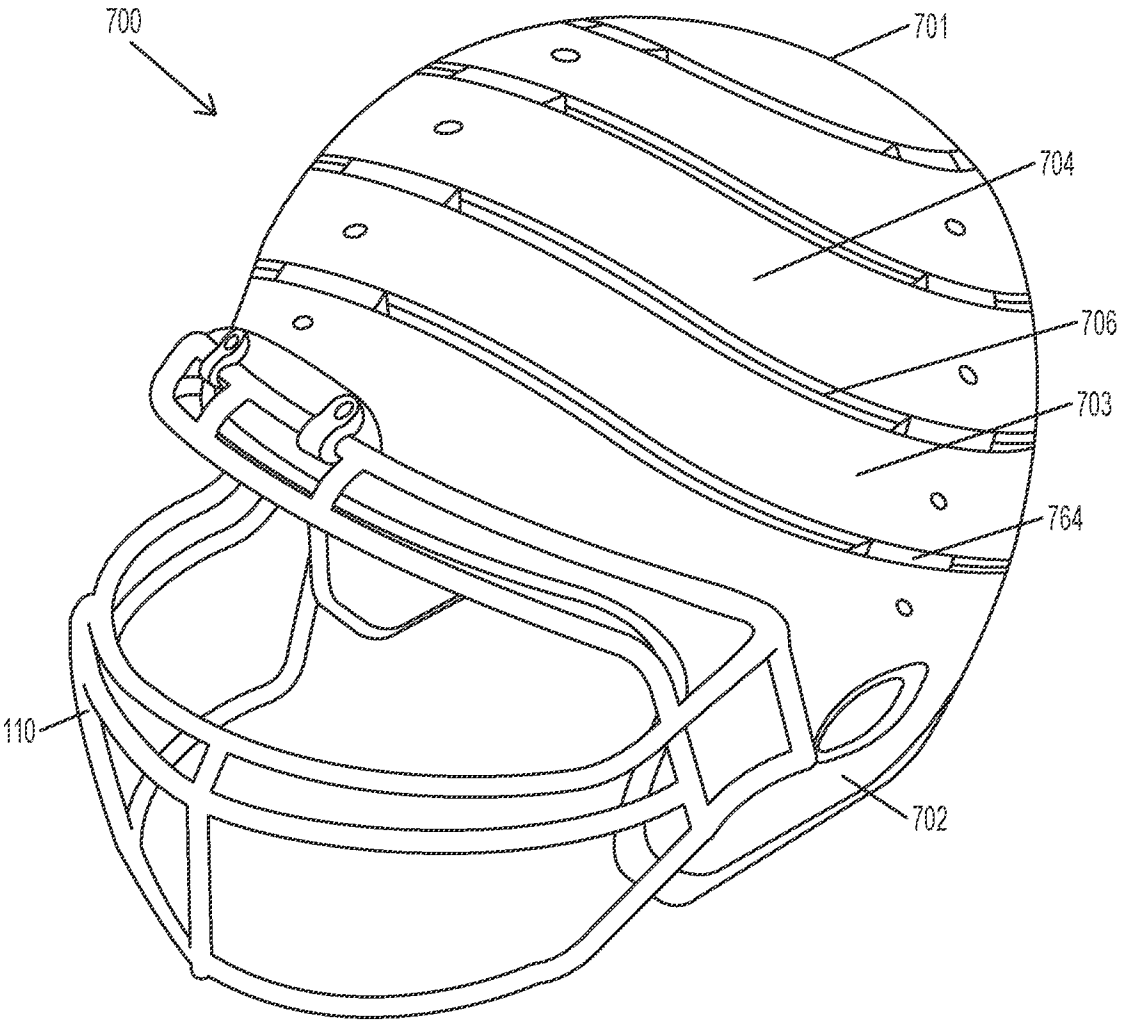
FIG. 32 shows a football helmet according to another embodiment.

In FIG. 32, an embodiment is illustrated where rigid or semi-rigid panels 704 are provided in the form of rings. Each panel 704 is attached one or more adjacent panels via compliant connections 764 such that they can shift relative to one another by deforming the complaint connections 764. A lowermost panel 703 is attached to a frame member 702 via complaint connections 764, and an uppermost panel 701 is a substantially circular plate. The panels 704 may be made of any suitable polycarbonate, metal, hard plastic, or any suitable material or combination of materials to maintain the integrity of the helmet. In some embodiments, each panel 704 can deform inwardly or downwardly in order to compress an underlying air bladder upon impact. Other areas of the air bladders may expand outwardly to dissipate some of the energy of the impact.

Figure 34:
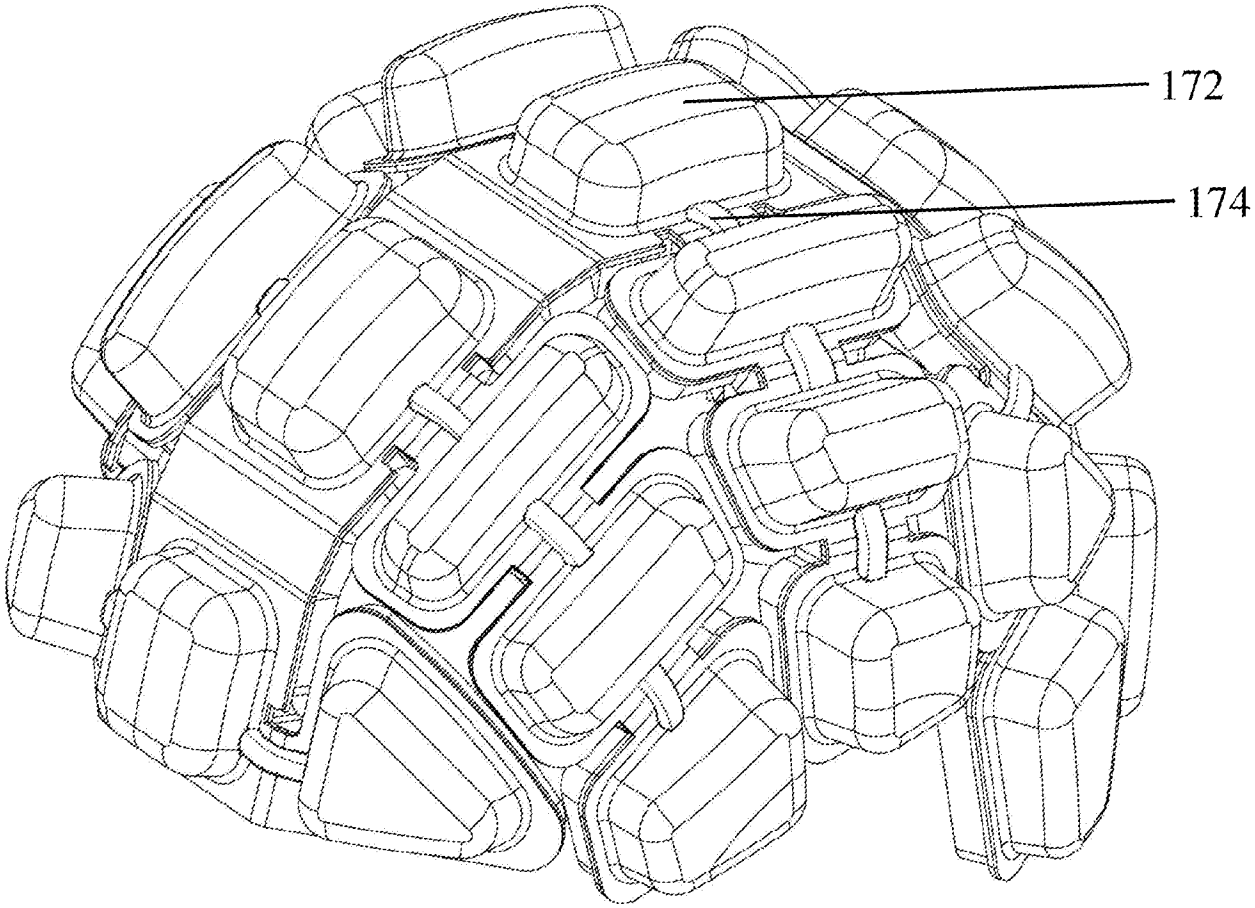
FIG. 34 is a top perspective view of interconnected air bladders usable with helmets disclosed herein.
Figure 35:
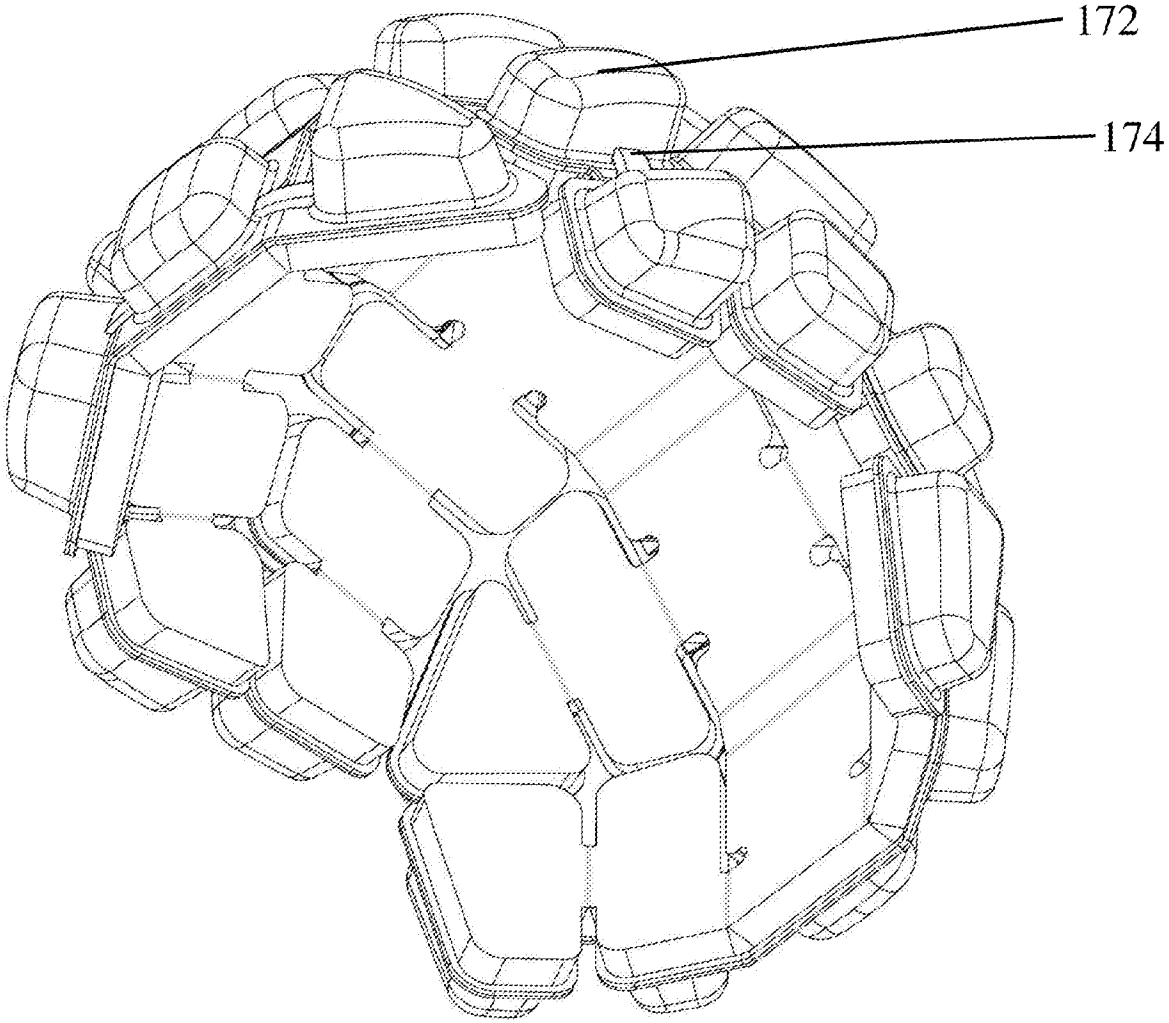
FIG. 35 is a bottom perspective view of the air bladders.

As mentioned above with reference to FIGS. 4 and 33, air bladders may be used with various helmet embodiments disclosed herein. FIGS. 34 and 35 show one embodiment of a set of air bladders 172 formed into a layer of air bladders. The layer of air bladders may be positioned below the plates of the helmet. Some or all of the air bladders 172 may be connected to one or more other air bladders via connecting channels 174, 175, which channels allow airflow between the bladders. As described above, upon impact to the helmet, the plates shift/deform inwardly and compress some of the air bladders. Upon compression, air in the impacted bladder(s) shifts to other bladders via the connecting channels 174, 175, causing the connected bladders to expand and push outwardly on the plates above them. In this manner, some of the energy from the impact can be dissipated through the expansion of air bladders and/or the movement of plates in an area outside of the impact region.

Figure 36:
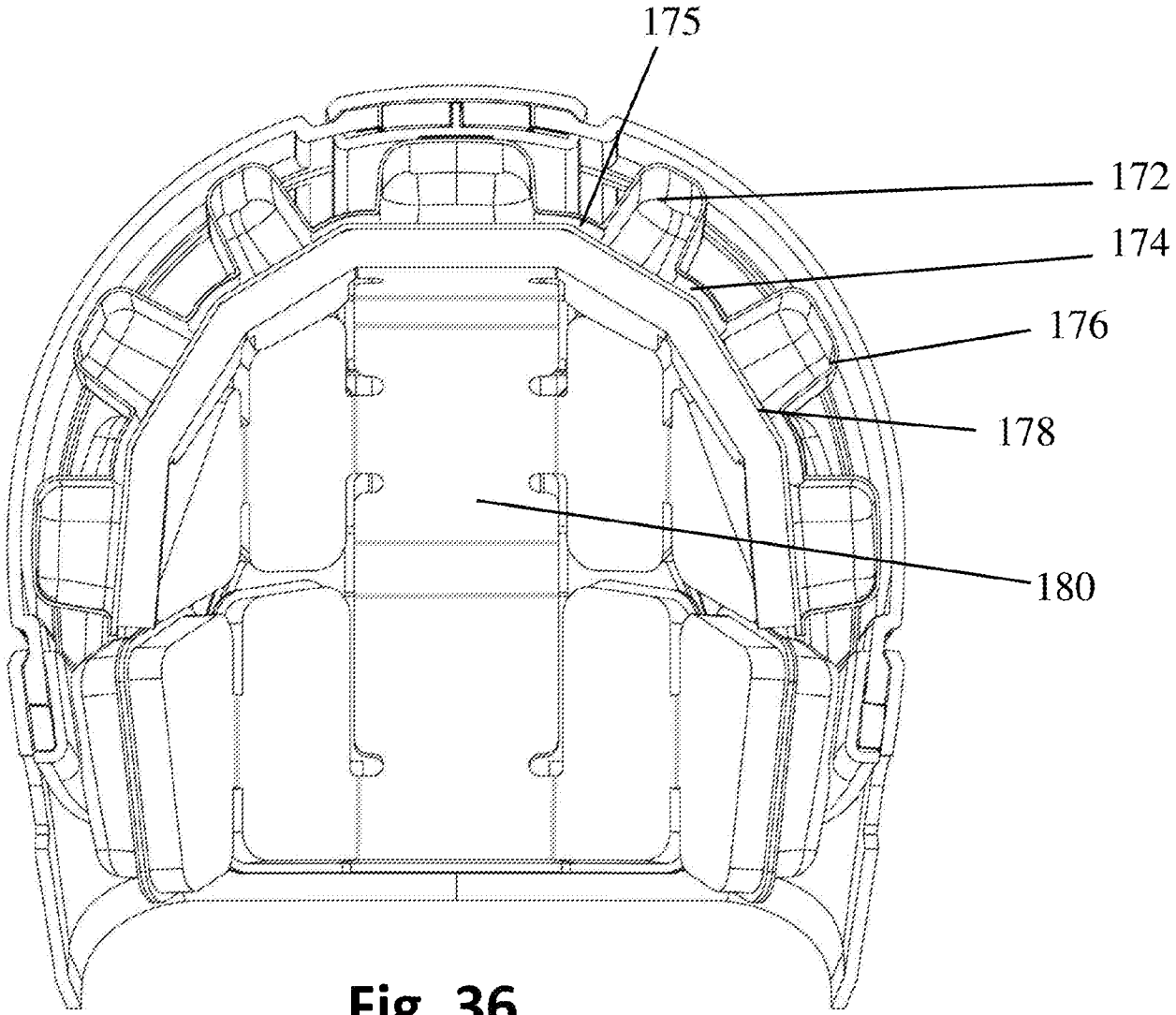
FIG. 36 is a cross-section front view of a helmet with air bladders.

As can be seen in FIG. 36, outer walls 176 of the air bladders are thinner than inner walls 178 in the illustrated embodiment. Such an arrangement may permit the air bladders to expand outwardly more than inwardly when air is pushed into the bladders. Internal padding, such as foam padding 180 may be positioned inwardly of the air bladder layer. In some embodiments, air bladders may be used which are not interconnected with other air bladders.

Figure 39:
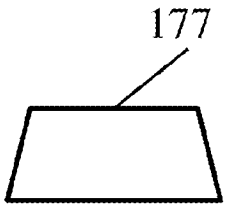
FIG. 39 is a cross-sectional view of a second air bladder channel.
Figure 38:
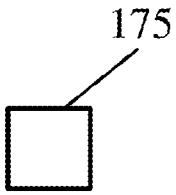
FIG. 38 is a cross-sectional view of a second air bladder channel.
Figure 37:
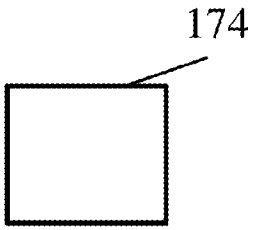
FIG. 37 is a cross-sectional view of a first air bladder channel.

The channels connecting air bladders may be tuned to provide varying levels of resistance to air flow between certain air bladders and/or limit flow to a single direction. For example, channel 174 may have a first cross-sectional area, while channel 175 has a second, different cross-sectional area, as shown in FIGS. 37 and 38. In some embodiments, the channels may have different cross-sectional shapes. For example, as shown in FIG. 39, a channel 177 may have a trapezoid shape while other channels in the same helmet have rectangular cross-sections. By providing channels having different resistances to air flow, the rate of collapse and/or inflation of certain air bladders may be tuned to provide specific characteristics. In some embodiments, a check valve may be provided to allow flow in only one direction between two bladders.

Figure 40:
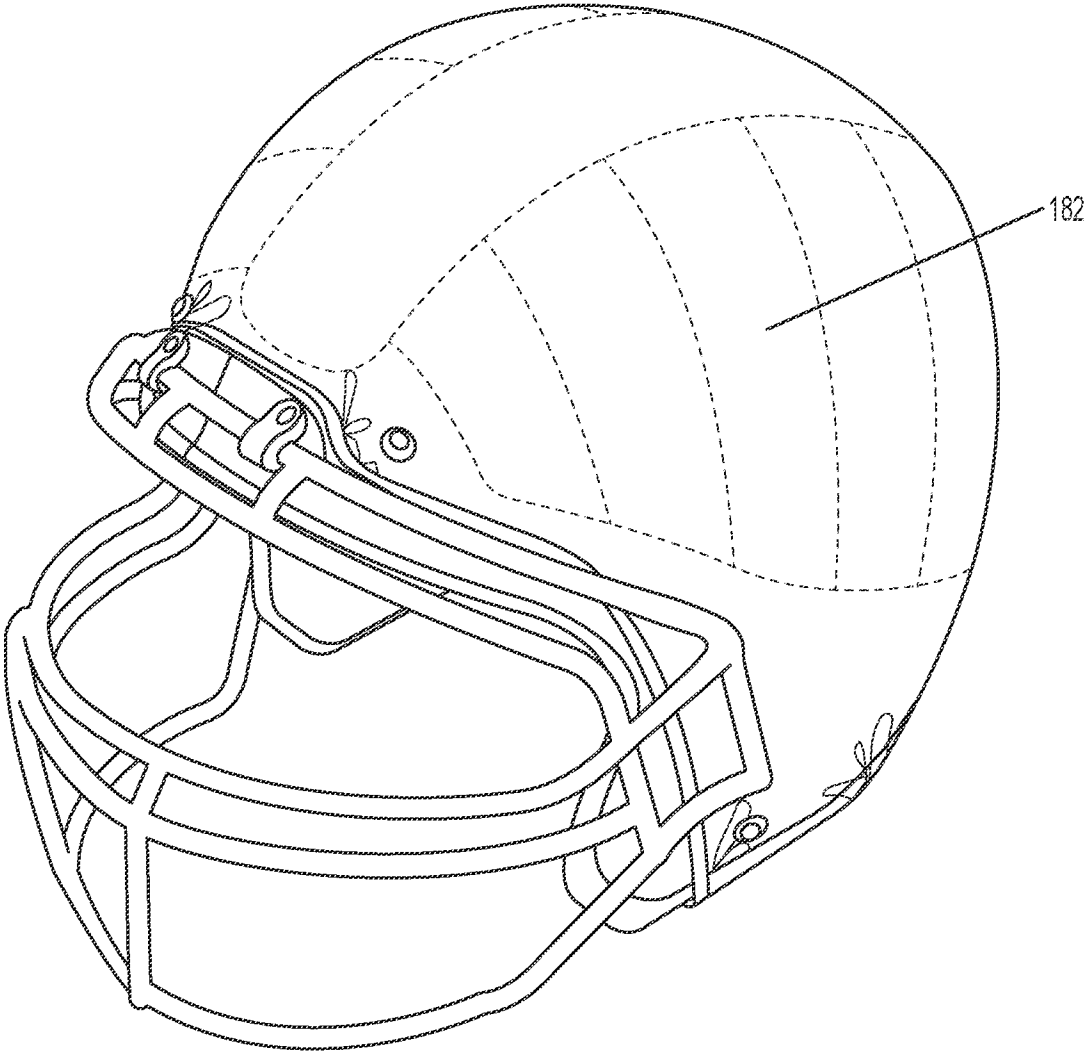
FIG. 40 is a perspective view of a helmet with a resilient outer sleeve according to one embodiment.

In each of the embodiments described herein, a tight-fitting sleeve may cover the helmet. The sleeve may be resilient such that sleeve acts to return the plates to their home positions after an impact. Additionally, the sleeve may have an elasticity and such that it is arranged to limit the degree of movement of the plates. The sleeve can be constructed of any suitably elastic material that can reversibly stretch. A sleeve 182 is shown in cross-section on the outside of the plates in FIG. 40. FIG. 40 shows sleeve 182 wrapped around substantially the entire outer surface of the helmet with the boundaries between the underlying plates shown in dashed lines.

Figure 41:
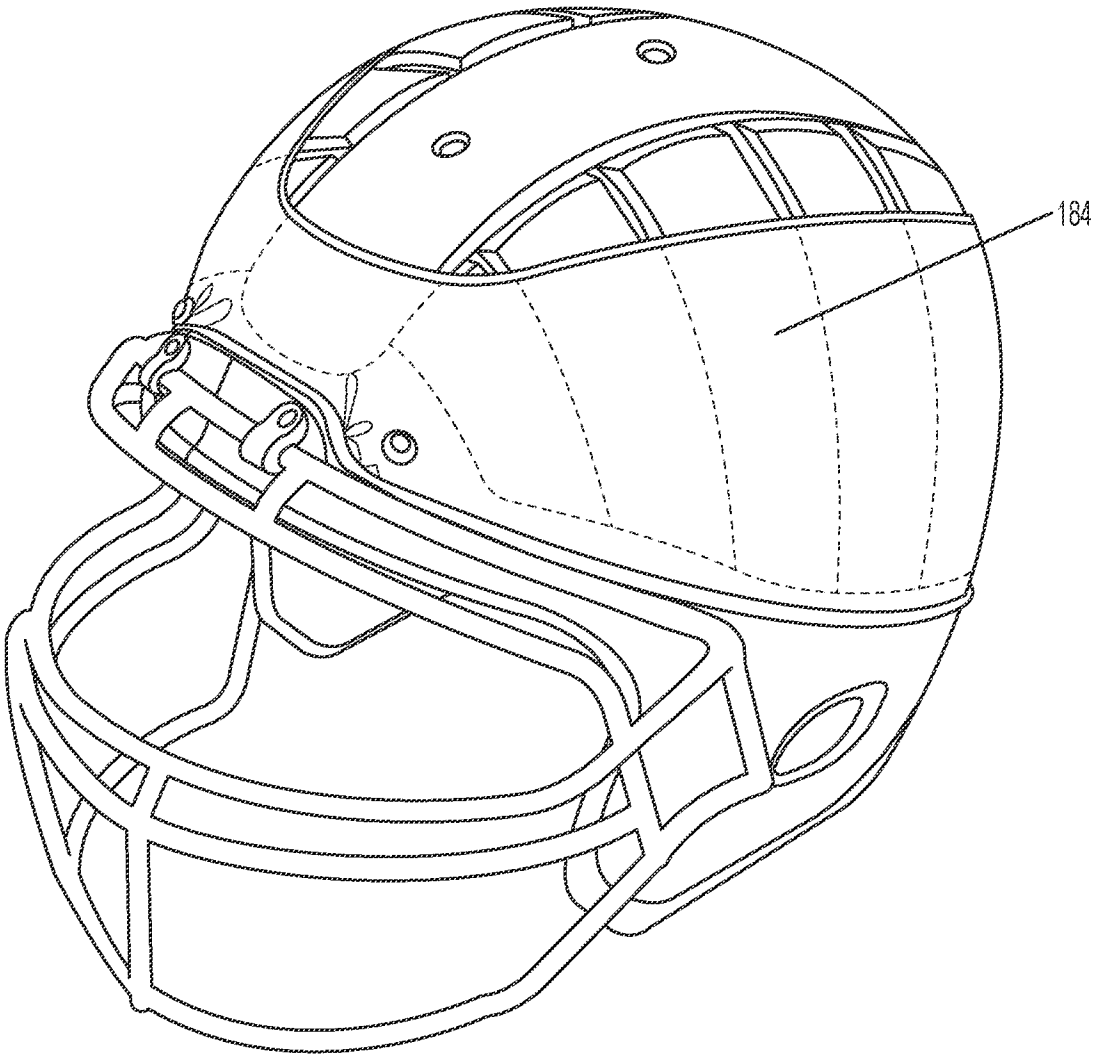
FIG. 41 is a perspective view of a helmet with a resilient outer band according to one embodiment.

In some embodiments, a resilient fabric is formed as a band 184 which extends horizontally around the helmet, as shown in the embodiment of FIG. 41.

Instead of being positioned on the outside of the helmet, resilient fabric or other resilient material may be embedded in the plates and connect the plates such that when the plates are pulled apart, the resilient material urges the plates back toward each other. In some embodiments, the resilient fabric may be secured to an underside of the plates.

As described above, the resilient material may include spandex, elastane, rubber, polyester-polyurethane, or any other suitable resilient material.

In each of the embodiments described herein, some or all of the compliant connections may include springs without or without a resilient insert.

The use of springs and/or resilient material insert arrangements disclosed herein as energy absorbing elements may be used in other applications beyond helmets. The shapes, dimensions, and materials of the plates, springs, and resilient material inserts may be adapted for specific applications. For example, flame-retardant resilient material inserts and springs with large stiffness coefficients may be used for automotive safety.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A helmet comprising:

a helmet front, a helmet rear including a rear base, and first and second helmet sides including first and second lower helmet sides;

an upper longitudinal frame member extending from the helmet front to the helmet rear;

a rigid lower frame member extending from the rear base of the helmet toward the helmet front along each of the first and second lower helmet sides, the rigid lower frame member being spaced from the upper frame member along the first and second helmet sides such that the upper frame member and the rigid lower frame member are positioned to cover different areas of the helmet;

a first plate that is semi-rigid or rigid, the first plate extending from the upper frame member toward the rigid lower frame member and being movable relative to the upper frame member, wherein the first plate forms at least a portion of an outer surface of an outermost shell of the helmet;

wherein the upper frame member is configured to limit movement of the first plate and the rigid lower frame member is configured to limit movement of the first plate;

wherein the rigid lower frame member includes a continuous unitary piece which extends from the rear base to the helmet front, and the rigid lower frame member forms an outer surface of the outermost shell of the helmet;

a first resilient, compressible material is positioned to be compressed by movement of the first plate toward the upper frame member; and a second plate and a first air bladder positioned under the first plate, and a second air bladder positioned under the second plate such that an external impact on the first plate causes the second air bladder under the second plate to expand and cause the second plate to move outwardly from the helmet.

2. A helmet as in claim 1, further comprising an expandable, resilient material arranged to bias the first plate towards a home position when the first plate is moved away from the home position, and wherein the upper longitudinal frame member forms an outer surface of the outermost shell of the helmet.

3. A helmet as in claim 1, further comprising a second resilient, compressible material positioned between the first plate and the rigid lower frame member, and wherein the rigid lower frame member comprises a channel, and a lower end of the first plate is located within the channel.

4. A helmet as in claim 1, wherein the compressible material comprises one or more pairs of longitudinal rails with V-shaped joints between the rails.

5. A helmet as in claim 4, wherein an external impact on a first plate causes at least a portion of the V-shaped joints to reversibly compress together.

6. A helmet as in claim 5, wherein the movement of the first plate causes a second plate to shift outwardly, causing at least a portion of the V-shaped joints to reversibly expand.

7. A helmet as in claim 1, wherein the helmet comprises a front frame member, and the upper longitudinal frame member is attached to the front frame member with a fastener that is located at the upper longitudinal frame member and at the front frame member, and the upper frame member is movable toward and away from the front frame member at the helmet rear.

8. A helmet as in claim 7, wherein the lower frame member extends to the helmet front to form the front frame member.

9. A helmet as in claim 1, wherein the upper longitudinal frame member is attached to the lower frame member at the helmet rear with a fastener that is located at the upper longitudinal frame member and at the lower frame member, and the upper longitudinal frame member is movable toward and away from the lower frame member at the helmet rear.

10. A helmet comprising:

a helmet front, a helmet rear including a rear base, and first and second helmet sides including first and second lower helmet sides;

an upper longitudinal frame member extending from the helmet front to the helmet rear;

a rigid lower frame member extending from the rear base of the helmet toward the helmet front along each of the first and second lower helmet sides, the rigid lower frame member being spaced from the upper frame member along the first and second helmet sides such that the upper frame member and the rigid lower frame member are positioned to cover different areas of the helmet;

a first plate that is semi-rigid or rigid, the first plate extending from the upper frame member toward the rigid lower frame member and being movable relative to the upper frame member, wherein the first plate forms at least a portion of an outer surface of an outermost shell of the helmet;

wherein the upper frame member is configured to limit movement of the first plate and the rigid lower frame member is configured to limit movement of the first plate;

wherein the rigid lower frame member includes a continuous unitary piece which extends from the rear base to the helmet front, and the rigid lower frame member forms an outer surface of the outermost shell of the helmet;

a first resilient, compressible material is positioned to be compressed by movement of the first plate toward the upper frame member;

a second plate that is semi-rigid or rigid, the second plate extending from the upper frame member toward the rigid lower frame member and being movable relative to the upper frame member, wherein the second plate forms at least a portion of an outer surface of an outermost shell of the helmet wherein the first plate is positioned on an opposite side of the helmet from the second plate; and first and second air bladders positioned under the first and second plates, respectively, the first and second air bladders being fluidically connected to each other; wherein the helmet is configured such that an external impact to the first plate causes the first air bladder to compress and the second air bladder to expand.

11. A helmet comprising:

a helmet front, a helmet rear including a rear base, and first and second helmet sides including first and second lower helmet sides;

a first longitudinal rigid frame member extending from the helmet front to the helmet rear over a crown of the helmet, and a second rigid frame member extending from the rear base of the helmet toward the front of the helmet along each of the first and second lower helmet sides, the second rigid frame member being spaced from the first longitudinal rigid frame member along each of the first and second helmet sides, wherein the second rigid frame member includes a continuous unitary piece which extends from the rear base to the helmet front;

a plurality of semi-rigid or rigid plates each plate of the plurality of plates being connected to the first longitudinal rigid frame member and the second rigid frame member, each of the plurality of plates having a respective home position, and each of the plurality of plates having an outer side, an inner side, and a thickness;

wherein the plurality of plates are movable relative to at least one of the first and second rigid frame members and out of their home positions; and wherein the outer side of each of at least some plates of the plurality of plates forms at least a portion of an outer surface of an outermost shell of the helmet;

a resilient material positioned at least partially between the plurality of semi-rigid or rigid plates and the first rigid frame member;

wherein the helmet is configured such that an external impact to a first plate of the plurality of semi-rigid or rigid plates at least partially compresses the resilient material against the first rigid frame member; and a first air bladder positioned under a first plate of the plurality of semi-rigid or rigid plates, and a second air bladder positioned under a second plate of the plurality of semi-rigid or rigid plates, the plurality of plates and the first and second air bladders being configured such that an external impact on the first plate of the plurality of plates causes the second plate of the plurality of semi-rigid or rigid plates to move outwardly from the helmet.

12. A helmet comprising:

a crown, a helmet front which is forward of the crown, a helmet rear which is rearward of the crown, and left and right helmet sides;

a first frame member extending from the helmet front to the helmet rear;

a second rigid frame member spaced from the first frame member along left and right sides of the helmet;

a plurality of plates that are semi-rigid or rigid and moveable relative to each other, the plurality of plates forming at least a portion of an outer surface of an outermost shell of the left and right sides of the helmet, wherein each plate of the plurality of plates has a first end region and each plate of the plurality of plates is movably connected at the plate's first end region to the first frame member, and each plate of the plurality of plates has a second end region that is opposite to the first end region of the same plate, and each second end region extends toward the second frame member; and a resilient, compressible material positioned at least partially between each of the first end regions and the first frame member and arranged such that an impact to an external surface of a first plate of the plurality of plates compresses the resilient, compressible material positioned between the first frame member and the first end region of the first plate;

wherein the first frame member is an upper frame member, and the second rigid frame member is a lower frame member, and wherein the lower frame member includes a continuous unitary piece which extends from the helmet rear to the helmet front;

the lower frame member forms a portion of an outer surface of the outermost shell;

the lower frame member is connected to the helmet such that the lower frame member is connected to the helmet when the helmet is not being worn; and an upper edge of the lower frame member is positioned to be lower on a wearer's head along the left and right and sides of the helmet than a lower edge of the upper frame member;

one or more air bladders positioned inside the plurality of plates such that an external impact on the first plate causes a second plate to move outwardly from the helmet, and wherein the second plate is on an opposite side of the helmet from the first plate.

13. A helmet comprising:

a helmet front, a helmet rear, and left and right helmet sides;

an upper frame member extending from the helmet front to the helmet rear;

a lower rigid frame member extending along a lower periphery of the helmet on the left and right helmet sides, the lower frame member being spaced from the upper frame member along the left helmet side and the right helmet side, the lower rigid frame member comprising polycarbonate, metal, or hard plastic;

a first semi-rigid or rigid plate positioned on the left helmet side and extending from the lower frame member toward the upper frame member, the first plate having a first upper end, and the first plate comprising acrylonitrile butadiene styrene and/or polycarbonate or comprising a carbon fiber composite material;

a second semi-rigid or rigid plate positioned on the right helmet side and extending from the lower frame member toward the upper frame member, the second plate having a second upper end, and the second plate comprising acrylonitrile butadiene styrene and/or polycarbonate or comprising a carbon fiber composite material;

and a first resilient, compressible material positioned between the first upper end of the first plate and the second upper end of the second plate;

wherein the first semi-rigid or rigid plate forms at least a portion of an outer shell of the helmet, and the second semi-rigid or rigid plate forms at least a portion of the outer shell of the helmet;

wherein internal padding is positioned inwardly of the outer shell;

wherein the lower frame member is configured to limit movement of the first and second plates; and the helmet is configured such that the upper end of the first plate is movable toward and away from the upper end of the second plate;

a third semi-rigid or rigid plate positioned on the helmet left side and extending from the lower frame member toward the upper frame member, the third plate having a third upper end, and the entire third plate being positioned rearward of the entire first plate in a direction from the helmet front toward the helmet rear;

a fourth semi-rigid or rigid plate positioned on the helmet right side and extending from the lower frame member toward the upper frame member, the fourth plate having a fourth upper end, and the entire fourth plate being positioned rearward of the entire second plate in a direction from the helmet front toward the helmet rear; wherein a second resilient, compressible material is positioned between the third upper end of the third plate and the fourth upper end of the fourth plate;

wherein the lower frame member is configured to limit movement of the third and fourth plates; and the helmet is configured such that the upper end of the third plate is movable toward and away from the upper end of the fourth plate.

14. The helmet of claim 13, wherein the first semi-rigid or rigid plate comprises first and second elongate sections separated by a first slot and joined at a first lower end, and the second semi-rigid or rigid plate comprises third and fourth elongate sections separated by a second slot and joined at a second lower end.

15. A helmet as in claim 13, wherein the first resilient, compressible material extends along a length of the upper frame member.

16. A helmet as in claim 13, wherein the upper frame member is spaced from the lower frame member such that:

(a) on the left helmet side, a first helmet area is not covered by the upper frame member and not covered by the lower frame member; and (b) on the right helmet side, a second helmet area is not covered by the upper frame member and not covered by the lower frame member.

17. A helmet as in claim 13, wherein the lower frame member is attached to the upper frame member at the helmet front, and the lower member is movable relative to the upper frame member at the helmet front, and a compressible material is located between the lower frame member and the upper frame member.

* * * * *